US009233398B2

(12) United States Patent
Dahl

(10) Patent No.: US 9,233,398 B2
(45) Date of Patent: Jan. 12, 2016

(54) FEEDER CHANNEL FOR MUD SHAKER

(75) Inventor: Bjørn Dahl, Loen (NO)

(73) Assignee: OPTIPRO AS, Loen (NO)

( * ) Notice: Subject to any disclaimer, the term of this patent is extended or adjusted under 35 U.S.C. 154(b) by 411 days.

(21) Appl. No.: 13/702,894

(22) PCT Filed: May 16, 2011

(86) PCT No.: PCT/NO2011/000152
§ 371 (c)(1),
(2), (4) Date: Dec. 20, 2012

(87) PCT Pub. No.: WO2011/145945
PCT Pub. Date: Nov. 24, 2011

(65) Prior Publication Data

US 2013/0139914 A1 Jun. 6, 2013

Related U.S. Application Data

(60) Provisional application No. 61/347,258, filed on May 21, 2010.

(30) Foreign Application Priority Data

May 20, 2010 (NO) ..... 20100746

(51) Int. Cl.
*B07B 13/16* (2006.01)
*E21B 21/06* (2006.01)

(52) U.S. Cl.
CPC ..... *B07B 13/16* (2013.01); *E21B 21/065* (2013.01); *Y10T 137/8593* (2015.04)

(58) Field of Classification Search
CPC ... E21B 21/063; E21B 21/065; E21B 21/066; B07B 13/16
USPC ..... 209/243, 244, 245, 246, 247, 250; 175/66, 206
See application file for complete search history.

(56) References Cited

U.S. PATENT DOCUMENTS 2,039,573 A * 5/1936 Weber ..... 210/389
3,540,596 A * 11/1970 Bugbee et al. ..... 210/328
(Continued)

FOREIGN PATENT DOCUMENTS

DE 638874 11/1936
WO WO 96/08301 A1 3/1996
(Continued)

*Primary Examiner* — Joseph C Rodriguez
(74) *Attorney, Agent, or Firm* — Birch, Stewart, Kolasch & Birch, LLP

(57) ABSTRACT

A feeder channel for use in a filter separator machine is used for separation of undesired particles from a well fluid used in petroleum industry which has a purpose of guiding fluid and particle flow to the area of the filter that provides the best utilization of available filtration area and includes: a feeder channel is arranged so that the upstream well fluid is guided via a guiding- and turning plate, which is installed in series in opposite repeated direction in which the outlet of each guiding- and the turning plate facing the center of the vertical line. The fluid will for this reason be independent on how the feeder channel is installed in the direction and angle, and will provide a homogeneous flow profile as it guided through the mouth guide plate and internal guide fin against the distribution plate. The fluid is then distributed to the filter's inner part and utilizes the entire filter surface area and the filter separator machines movement and function.

14 Claims, 28 Drawing Sheets

(56) References Cited

U.S. PATENT DOCUMENTS

| | | | | | |
|---|---|---|---|---|---|
| 3,852,197 | A | * | 12/1974 | Thompson | 210/143 |
| 4,202,777 | A | * | 5/1980 | Schall | 210/405 |
| 4,230,575 | A | * | 10/1980 | Lizee | 210/780 |
| 4,443,332 | A | | 4/1984 | de Nevers | |
| 4,940,535 | A | | 7/1990 | Fisher et al. | |
| 5,593,582 | A | | 1/1997 | Roff, Jr. | |
| 5,853,583 | A | * | 12/1998 | Shah | 210/340 |
| 6,223,906 | B1 | * | 5/2001 | Williams | 210/400 |
| 6,244,362 | B1 | * | 6/2001 | Williams | 175/206 |
| 6,530,482 | B1 | * | 3/2003 | Wiseman | 209/253 |
| 7,380,673 | B2 | * | 6/2008 | Fout et al. | 209/309 |
| 2009/0019443 | A1 | | 1/2009 | Jakob | |
| 2013/0220945 | A1 | * | 8/2013 | Carr et al. | 210/768 |

FOREIGN PATENT DOCUMENTS

| | | | |
|---|---|---|---|
| WO | WO 02/40186 | A1 | 5/2002 |
| WO | WO 03/028907 | A1 | 4/2003 |
| WO | WO 2009/111730 | A2 | 9/2009 |

* cited by examiner

Left side view

Rear view

Right side view

Front view

Perspective view

Left side view

Rear view

Right side view

Front view

Perspective view

Left side view

Rear view

Right side view

Front view

Perspective view

Left side view

Rear view

Right side view

Front view

Perspective view

Table A

Table B

Table 1

FEEDER CHANNEL FOR MUD SHAKER

CROSS REFERENCE TO RELATED APPLICATIONS

This application is the National Phase of PCT/NO2011/000152 filed on May 16, 2011, which claims priority under 35 U.S.C. 119(e) to U.S. Provisional Application No. 61/347,258 filed on May 21, 2010 and under 35 U.S.C. 119(a) to Patent Application No. 20100746 filed in Norway on May 20, 2010, all of which are hereby expressly incorporated by reference into the present application.

BACKGROUND OF THE INVENTION

1. Field of the Invention

The invention relates to an improved feeder channel for distribution of fluid and particles for a well fluid filter separator.

The invention relates to an improved feeder channel for the distribution of well fluid and particles which is fed into a filter separator machine used for separation of undesired particles from a well fluid used in petroleum industry. The separated particles may include cuttings, rock particles, metal particles, additive particles and chemicals. The well fluid may be a water-based (WBM) or an oil based (OBM) drilling fluid if filtering shall be conducted during drilling, or a so-called completion fluid if one intends to circulate under conditions other than drilling.

2. Description of Background Art

Each provider of filter separator machines (shale shakers) has developed their own design for feeder channels. The efficiency and practical usefulness of the fluid and particle distribution on the filter is varied. They do not fully utilize the potentially available filtration area, movement pattern (vibration) and transport length for particles on the filters, or the through flow of well fluids at the same. This potentially incurs reduced quality of the primary cleaning and hence increased consumption of such filters, well fluid and wear on all equipment in contact with the heterogeneous fluid in connection with the particle variations.

WO2009/111730 concerns a fluid distribution apparatus configured to receive a drilling material and direct the drilling material onto a separatory surface; and a damper coupled to the housing and configured to distribute a flow of the drilling material onto the separatory surface.

WO03/028907 describes a vibratory separator and a screen assembly. In the drilling of a borehole in the construction of an oil or gas well, a drill bit is arranged on the end of a drill string and is rotated to bore the borehole. A drilling fluid known as "drilling mud" is pumped through the drill string to the drill bit to lubricate the drill bit. The drilling mud is also used to carry the cuttings produced by the drill bit and other solids to the surface through an annulus formed between the drill string and the borehole. The drilling mud contains expensive synthetic oil-based lubricants and it is normal therefore to recover and re-use the used drilling mud, but this requires the solids to be removed from the drilling mud.

U.S. Pat. No. 4,940,535 relates to an apparatus which distributes the flow of solids to two or more solid separation devices. The apparatus comprises a plenum, such as a horizontally disposed elongated chamber, that is positioned above inlet zones of the solid separation devices. The plenum includes an inlet for communication with a source of the flow of solids and liquid, such as from a drilling well, and also includes lower outlets positioned adjacent the solids separation device's inlet zones. Valves are positioned across these lower outlets for regulating the quantity of solids and liquid that flow to each solid separation device. A variable distribution device, such as a movable or tiltable plate, is connected within the plenum adjacent the solids and liquid inlet for regulating the proportion of solids directed to each solid separation device.

U.S. Pat. No. 5,593,582 describes a shale shaker having two feeds, two screens, two mud outlets and a removable tray between the screens is disclosed. Each screen receives one feed and produces one outlet of cuttings and another outlet for separated mud for either bypass or direct feed to the mud tank or the other screen. The removable tray or trays facilitate the two screens acting in cascade. Valves are provided to control the overall flow rate to the shaker and to the lower level screen.

WO9608301 describes a vibratory screen filter apparatus. In the vibratory screen filter apparatus a plurality of vibratory screening units are provided. Each unit has its own filter screen and vibrating means for vibrating the screen, and receives mixture to the process from a common inlet reservoir which includes means for varying the relative rates of supply of mixture to the screens of the screening units. Sensor means detects the amount of mixture on each screen, and the output of the sensor means is used by control means which controls the amount of mixture deposited on each unit, and can selectively activate or de-activate units to cope with changes in the required rate at which the apparatus is to process a mixture of drilling mud and cuttings.

WO02/40186 discloses a shale shaker for separating material, the shale shaker comprising a basket for supporting a screen assembly, a collection receptacle, and a vibratory mechanism for vibrating the basket, the basket comprising two side walls, an end wall and an opening in the bottom of the basket, the basket having means to support screen assemblies for substantially covering the opening characterized in that the basket further comprises separating means in or on any of the walls for separating material. Preferably, the shale shaker further comprises directing means for directing separated material therefrom into said collection receptacle.

Explanation:

100% coverage ratio (DG) provides continuous loss of fluid on the top filter.

90% DG provides a risk of loss.

75% DG by even distribution front does not provide loss.

Table B: shows the cost per machine filter per drilled meter of formation of sections 24", 17.5", 12.25", and 8.5".

The numerical values are from the Norwegian Petroleum Directorate's website for the Norwegian sector for the period 1999-2008 and is based on well specified length. Based on this, the average consumption and the costs are estimated. This is defined as historical data.

An essential problem with the feeder channels in the background art is that they lead fluid and particle flow ahead on the filters in the filter separator machines movement and transport direction—see FIGS. 7A-11. This incurs in a reduced transport path in distance and time from the landing point on the filter to the outlet on the end of the same.

Common to FB & HB, Another essential problem is the lack of utilization of available filtration area of the inner portion of the filter, which is located under and behind the landing point of liquid and particles—see FIGS. 5-8B. This, in practice, provides reduced receiving capacity for liquid and particles at the same filter quality.

This is common for feeder box and header box devices. A third essential problem with the functional design of the feeder channel is that the feeding out section and the degree of cover distribution of fluid particles reflects how the supply to the feeder channel is oriented in its direction and angle.

A vertical or a perpendicular flow provides one type of flow distribution on the filter, see FIGS. 9A and 9B, the arrow indicates the direction of main flow.

An oblique flow from the left, versus right, provides other flow patterns for the same filter, see FIGS. 10 and 11. The arrow indicates the direction the main flow.

A fourth, substantial problem is related to the HSE (Health and Environment Safety) by personnel exposed to chemical composition of the drilling fluid (risk of chemical pneumonia, etc.) through increased handling of the increasing wear on the primary filter as reduced filter area leads to the use of coarse top filter (scalping screen). Coarser top filter lets through a significant amount of particles (volume & weight), incurring increased wear on the main filter. FIG. 12, Table A illustrates an approximate coverage on the top deck VS filter quality.

A fifth essential problem is economic related in that a high consumption of filter screens during the drilling of a well—please see FIG. 13, Table B, as well as the negative consequences this incurs to the operational progress, maintenance of equipment in the well and fixed or portable equipment on a rig. This is because the quality of the drilling fluid is influenced by the primary cleaning (filter separator machine with associated filter) through the particle content and size distribution (PSD).

SUMMARY OF THE INVENTION

A solution to several of the above mentioned problem, according to the invention is defined in the enclosed claim a feeder channel with a design that provides a homogeneous flow distribution of fluid and particles on the (top-) filter, as well as a landing point for the fluid with particles that utilizes the filter area to a large extent, approximately 100% under good conditions. A first advantage of the invention is that the fluid and particle flow is led to the beginning of the filter.

In this way almost 100% of the filter area is utilized, which among other factors, increases the duration of the filter through more evenly distributed wear. Please see FIGS. 19A-24.

A second advantage in that the device according to invention guides the fluid- and particle flow to the beginning of the filter (approximately 100% space utilization) is that the reception capacity of fluid and particles increases for that particular filter quality. This increase is expected to be approximately 10 to 40%.

A third advantage in that the [device according to] invention guides the fluid- and particle flow to the beginning of the filter (approximately 100% space utilization) is that it enables the use of finer filters for the same liquid flow as a result of a better coverage ratio. The latter results in an increased particle separation (volume and weight) on the top filter, which in turn results in a reduced wear on the primary filter, please see FIG. 25, Table 1.

A fourth advantage in that the invention guides the fluid- and particle flow to the beginning of the filter is that the transport path (distance and time) increases and thereby enables reduced adherence of the well fluid to the particles which are separated from the liquid phase. This has a positive environmental effect due to a reduced consumption of chemicals on the rig and a reduced need for post treatment (cleansing and disposal of waste) on land. In addition comes the positive Economic effect this provides to the owners.

A fifth advantage of the device according to the invention is that the flow distribution on the top filter will be approximately homogeneous and more independent of the orientation of the feed fluid's direction and angle. This increases reception capacity or allows for a finer filter quality in that the flow distribution on the top filter has a uniform border zone profile towards the end of the filter, please see FIGS. 22A-24:

A sixth advantage of the invention is economically related in reduced consumption of separator machine filter screens during the drilling of a well, as well as the positive consequences this causes to the operational progress, maintenance of equipment in the well and of fixed or portable equipment on the rig. This is because the quality of the drilling fluid is influenced by the primary cleaning (filter separator machine, with associated filter) through the particle content and size distribution (PSD).

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1A:
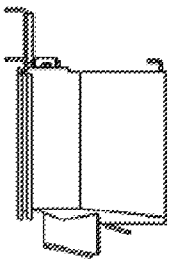
FIG. 1A PRIOR ART
FIGS. 1A-1E: Isometric drawings showing an example of a type of feeder channel to a filter separator machine with horizontal feeding of the fluid, a so-called "header box" wherein the fluid with particles is fed mainly in a horizontal direction from a box.
Figure 1B:
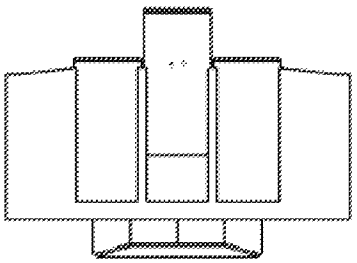
FIG. 1B PRIOR ART
Figure 1C:
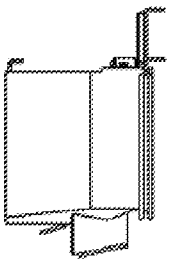
FIG. 1C PRIOR ART
Figure 1D:
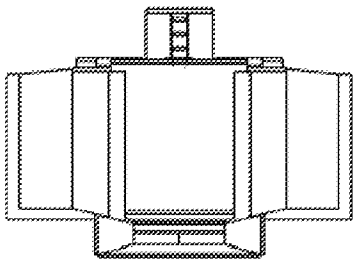
FIG. 1D PRIOR ART
Figure 1E:
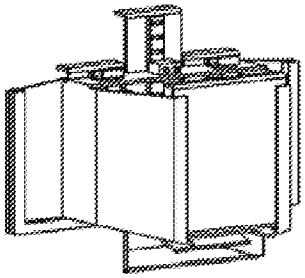
FIG. 1E PRIOR ART
Figure 2A:
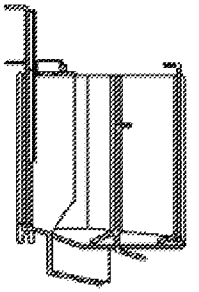
FIG. 2A PRIOR ART
FIGS. 2A-2E: Isometric drawings showing an example of a type of feeder channel to a filter separator machine with a horizontal feed of liquid.
Figure 2B:
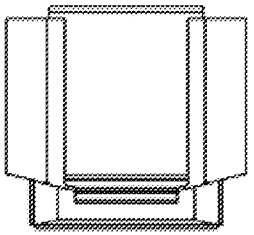
FIG. 2B PRIOR ART
Figure 2C:
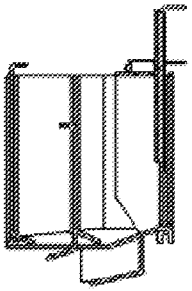
FIG. 2C PRIOR ART
Figure 2D:
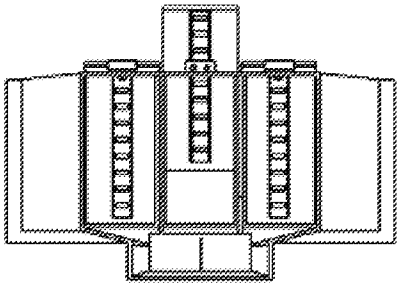
FIG. 2D PRIOR ART
Figure 2E:
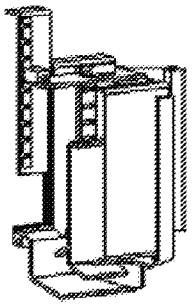
FIG. 2E PRIOR ART
Figure 3A:
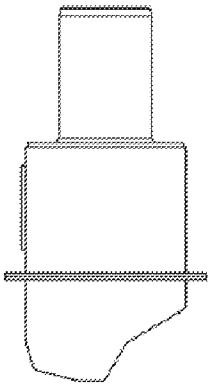
FIG. 3A PRIOR ART
FIGS. 3A-3E: Isometric drawings showing an example of a type of feeder channel to a filter separator machine with vertical feeding of liquid, a so-called "feeder box" wherein the liquid together with particles is fed essentially from above.
Figure 3B:
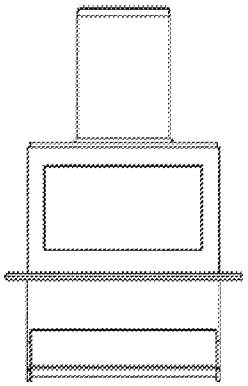
FIG. 3B PRIOR ART
Figure 3C:
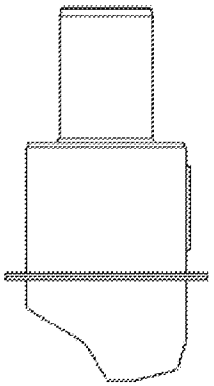
FIG. 3C PRIOR ART
Figure 3D:
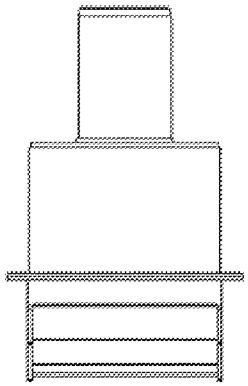
FIG. 3D PRIOR ART
Figure 3E:
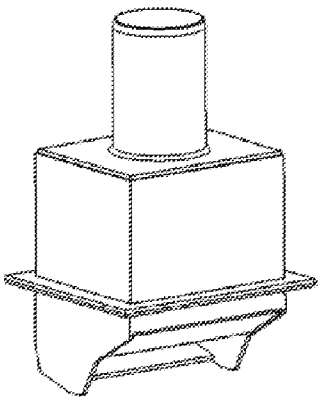
FIG. 3E PRIOR ART
Figure 4A:
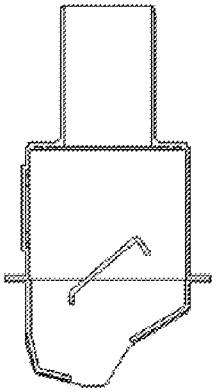
FIG. 4A PRIOR ART
FIGS. 4A-4E: Isometric drawings showing an example of a type of feeder channel to a filter separator machine with vertical feeding of fluid.
Figure 4B:
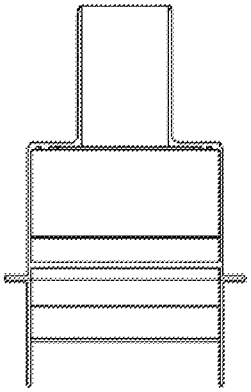
FIG. 4B PRIOR ART
Figure 4C:
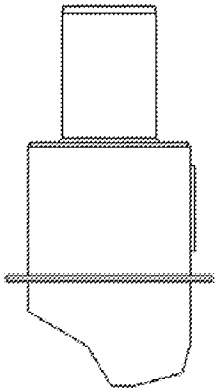
FIG. 4C PRIOR ART
Figure 4D:
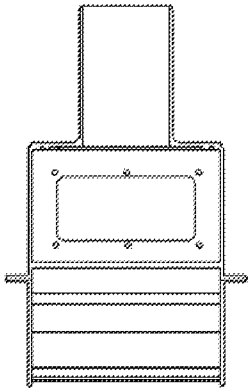
FIG. 4D PRIOR ART
Figure 4E:
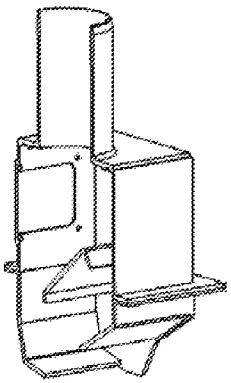
FIG. 4E PRIOR ART
Figure 5:
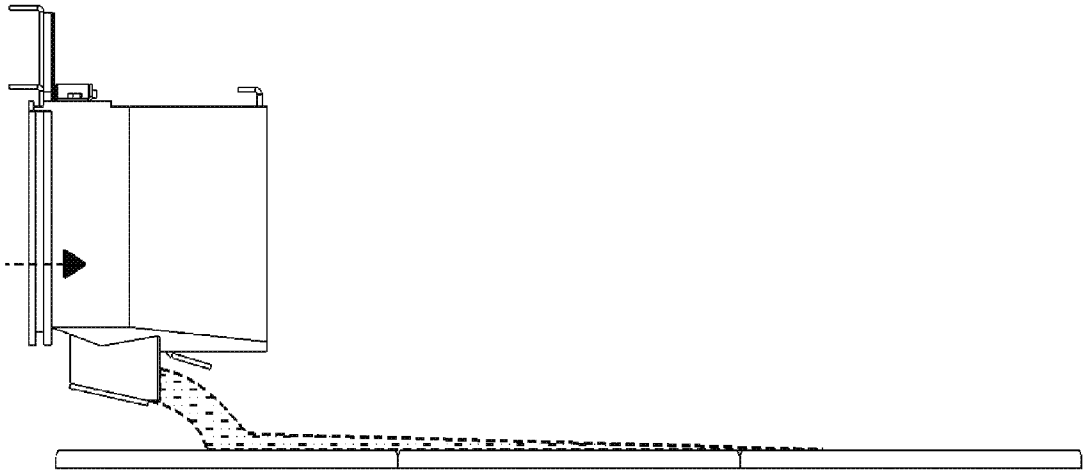
FIG. 5 PRIOR ART
FIG. 5: Isometric drawing showing an example of a type of feeder channel to a filter separator machine with a horizontal feeding of fluid and an installed separation filter.
Figure 6:
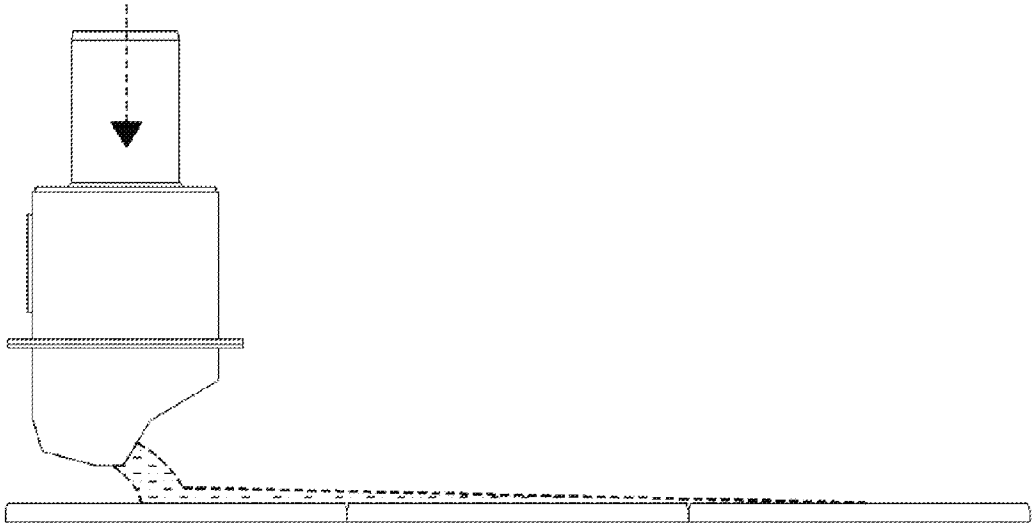
FIG. 6 PRIOR ART
FIG. 6: Isometric drawing showing an example of a type of feeder channel to a filter separator machine with vertical feeding of the fluid and an installed separation filter.
Figure 7A:
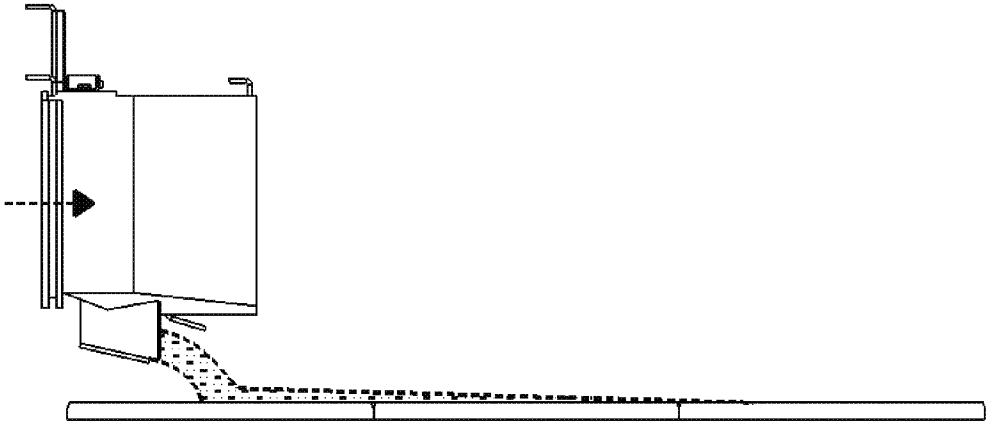
FIG. 7A PRIOR ART
FIGS. 7A and 7B: Isometric drawings of side elevation view and view in the plane showing an example of a type of feeder channel of a filter separator machine with a horizontal feed of fluid and distribution of the same on a separation filter.
Figure 7B:
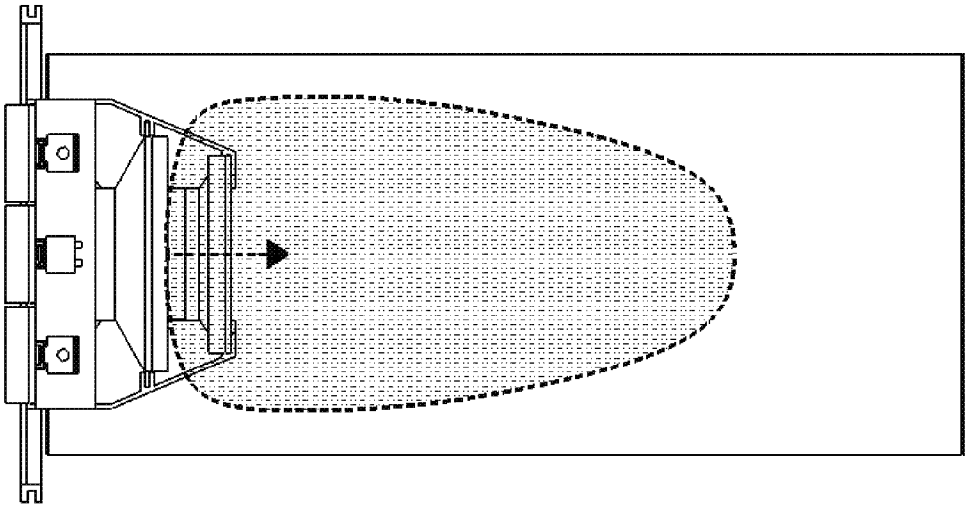
FIG. 7B PRIOR ART
Figure 8A:
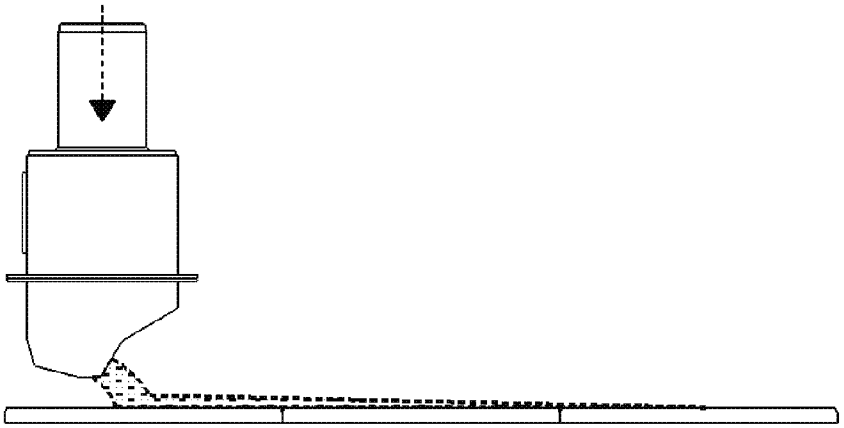
FIG. 8A PRIOR ART
FIGS. 8A-8B: Isometric drawings inside elevation view and view in the plane showing an example of a type of a feeder channel to a filter separator machine with vertical feeding of fluid and distribution of the same on a separation filter.
Figure 8B:
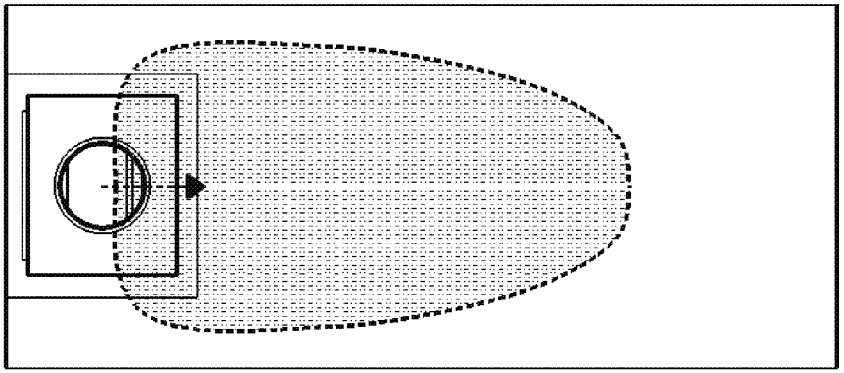
FIG. 8B PRIOR ART
Figure 9A:
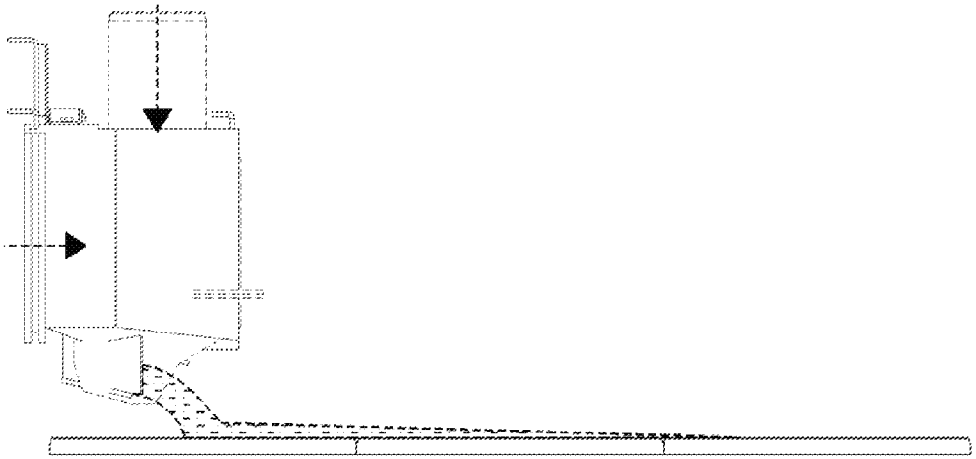
FIG. 9A PRIOR ART
FIGS. 9A, 9B, 10 and 11: Isometric drawing showing examples of flow distribution and coverage ratio of a homogeneous fluid on a separation filter in a filter separator machine. The feed angle of the fluid and main direction is indicated by arrows. Two types of feeder channels are presented together.
Figure 9B:
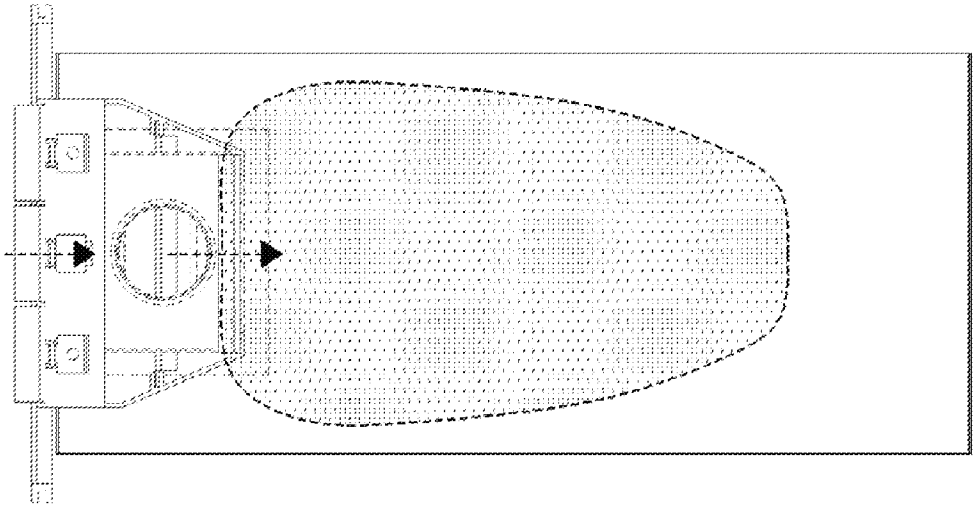
FIG. 9B PRIOR ART
Figure 10:
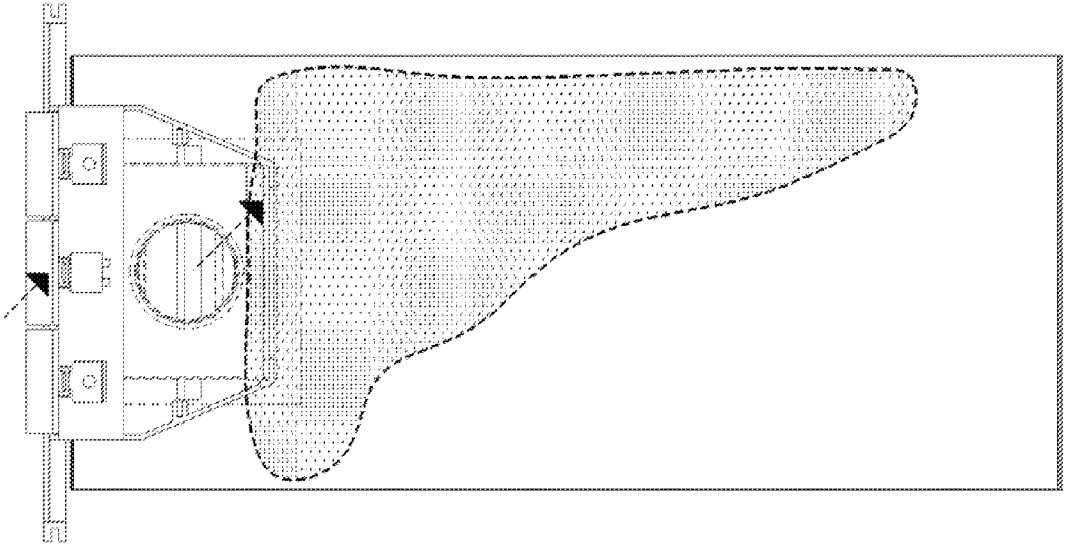
FIG. 10 PRIOR ART
Figure 11:
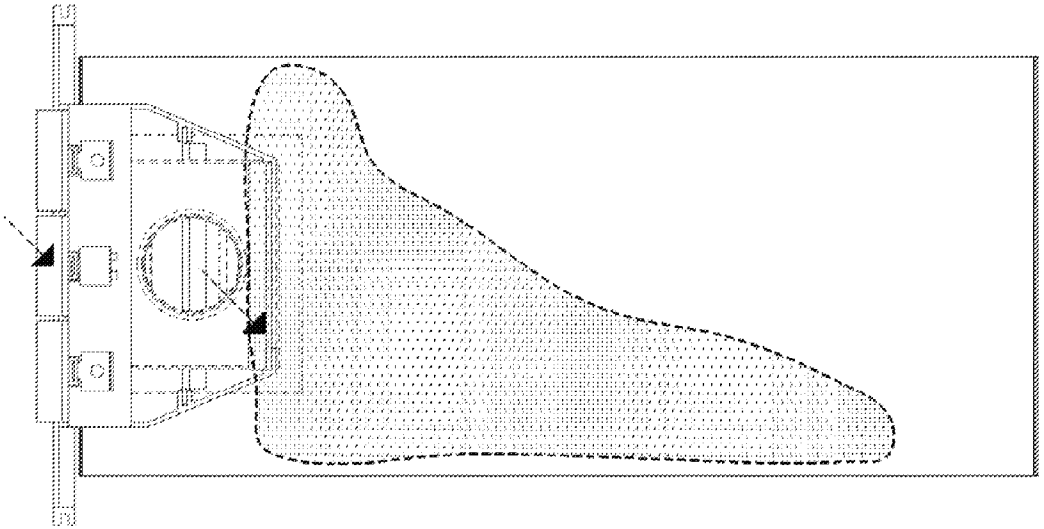
FIG. 11 PRIOR ART
Figure 12:
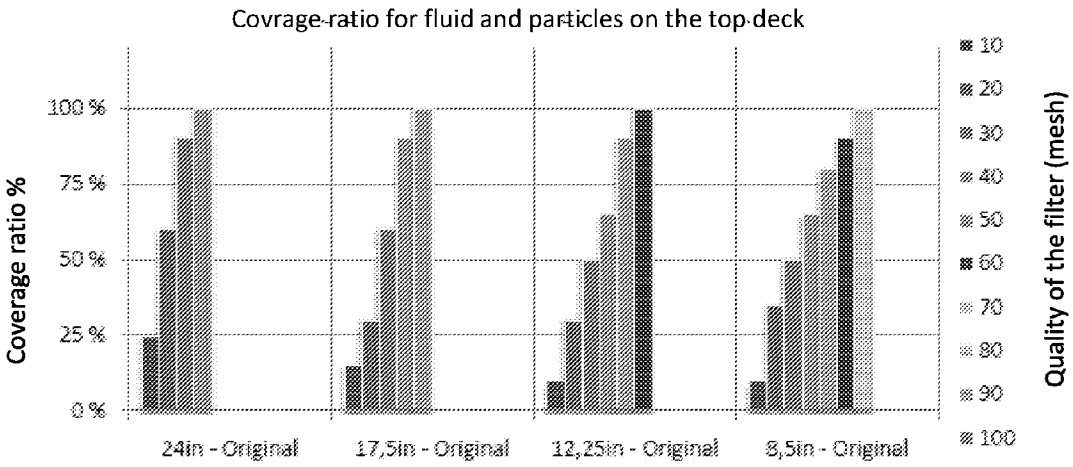
FIGS. 12 and 13, Table A and Table B: Shows examples of coverage ratio of fluid and particles on filter relative to filter quality (mesh) and presented for sections 24", 17.5", 12.25", and 8.5" (drilling of the well)
Figure 13:
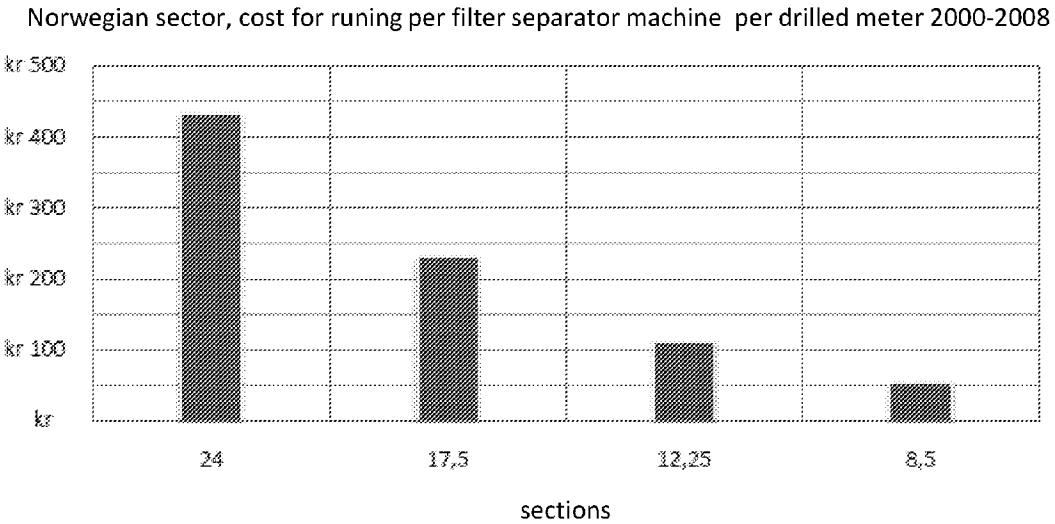
Figure 14A:
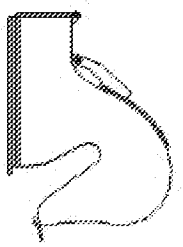
FIGS. 14A-14E: Isometric drawings shows an embodiment of the invention which is a feeder channel for a filter separator machine with a horizontal feeding of liquid, so-called a "header box"-embodiment.
Figure 14B:
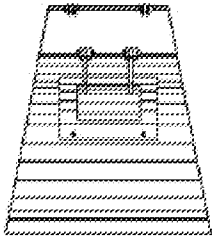
Figure 14C:
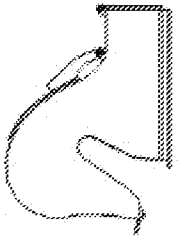
Figure 14D:
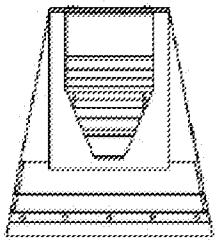
Figure 14E:
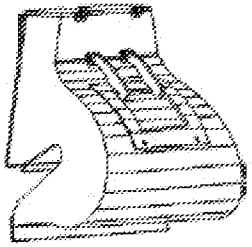
Figure 15A:
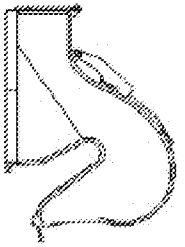
FIGS. 15A-15E: Isometric drawings showing an embodiment of the inventions feeder channel to a filter separator machine with a horizontal feed of fluid.
Figure 15B:
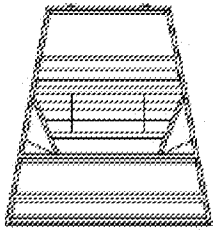
Figure 15C:
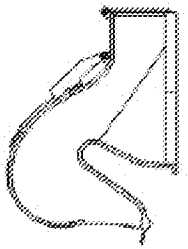
Figure 15D:
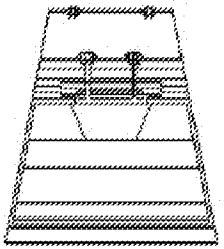
Figure 15E:
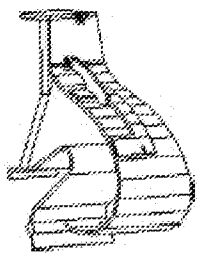
Figure 16A:
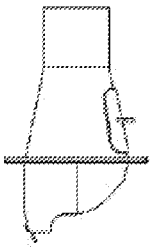
FIGS. 16A-16E: Isometric drawings showing an embodiment of the invention's feeder channel to a filter separator machine with vertical feeding of liquid, a so-called "feeder box" embodiment.
Figure 16B:
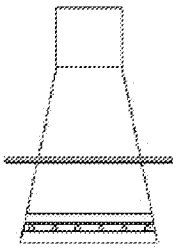
Figure 16C:
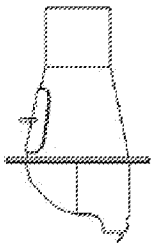
Figure 16D:
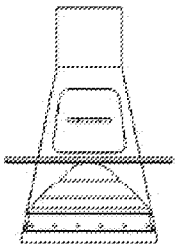
Figure 16E:
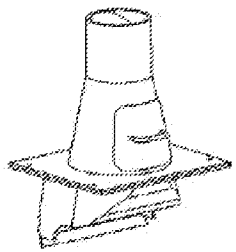
Figure 17A:
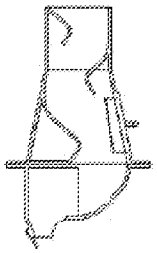
FIGS. 17A-17E: Isometric drawings showing an embodiment of the invention's feeder channel to a filter separator machine with vertical feeding of fluid.
Figure 17B:
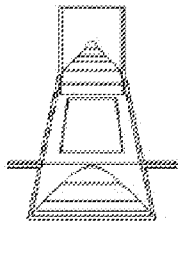
Figure 17C:
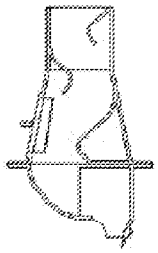
Figure 17D:
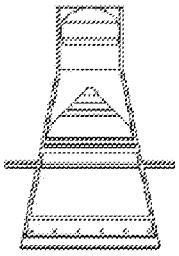
Figure 17E:
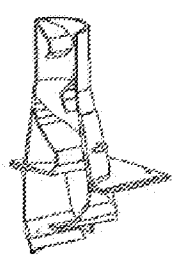
Figure 18A:
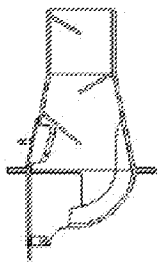
FIGS. 18A-18E: Isometric drawings showing an embodiment of the invention's feeder channel to a filter separator machine with vertical feeding of fluid.
Figure 18B:
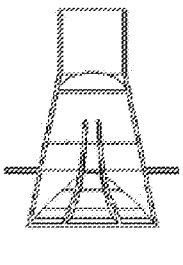
Figure 18C:
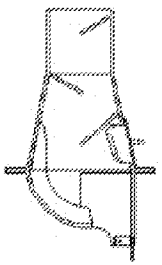
Figure 18D:
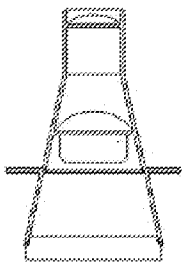
Figure 18E:
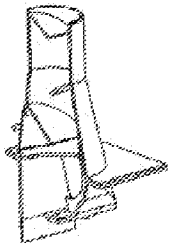
Figure 19A:
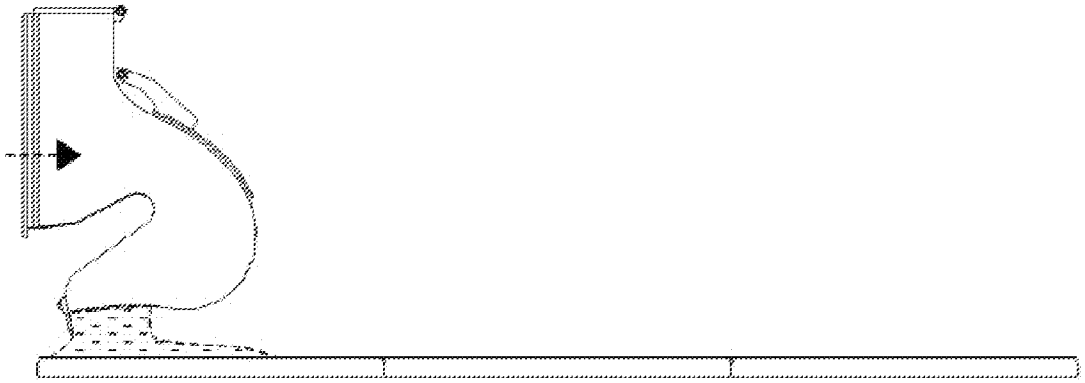
FIG. 19A: Isometric drawing showing an embodiment of the invention's feeder channel to a filter separator machine with horizontal feeding of fluid and with a separation filter installed.
Figure 19B:
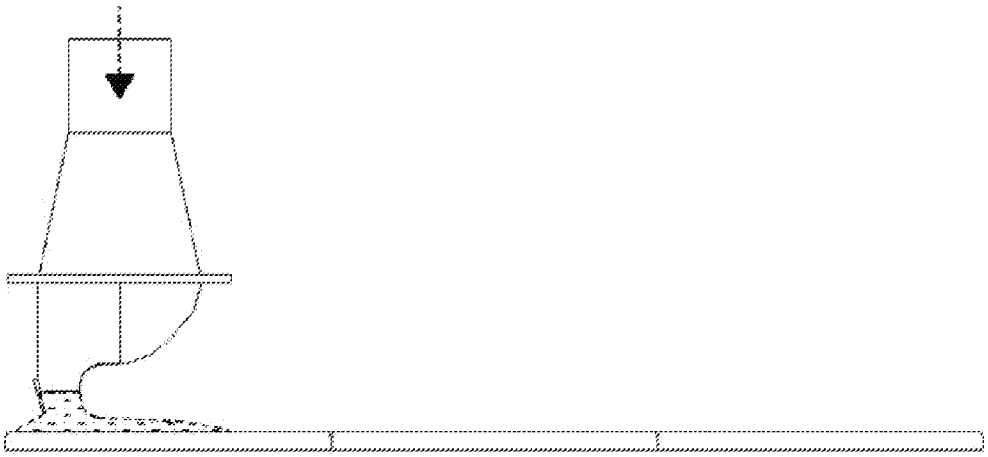
FIG. 19B: Isometric drawing showing an embodiment of the invention's feeder channel to the filter separator machine with vertical feeding of fluid and a separation filter installed.
Figure 20A:
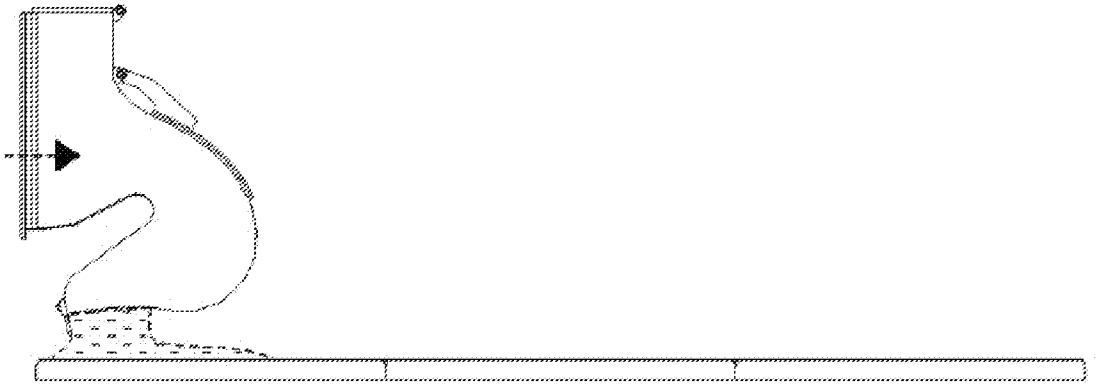
FIGS. 20A and 20B: Isometric drawings of elevation view and—view in the plane showing an embodiment of the inventions feeder channel to a filter separate machine with horizontal feed of fluid and example of flow distribution and coverage ratio of a homogeneous fluid on a separation filter relative to the feed angle of the fluid. The arrow indicates exemplary the main direction.
Figure 20B:
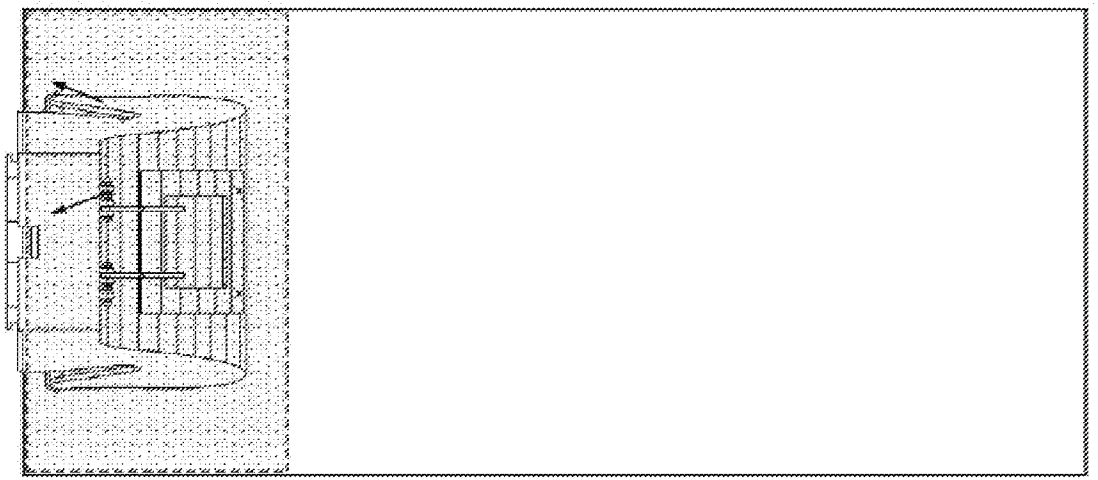
Figure 21A:
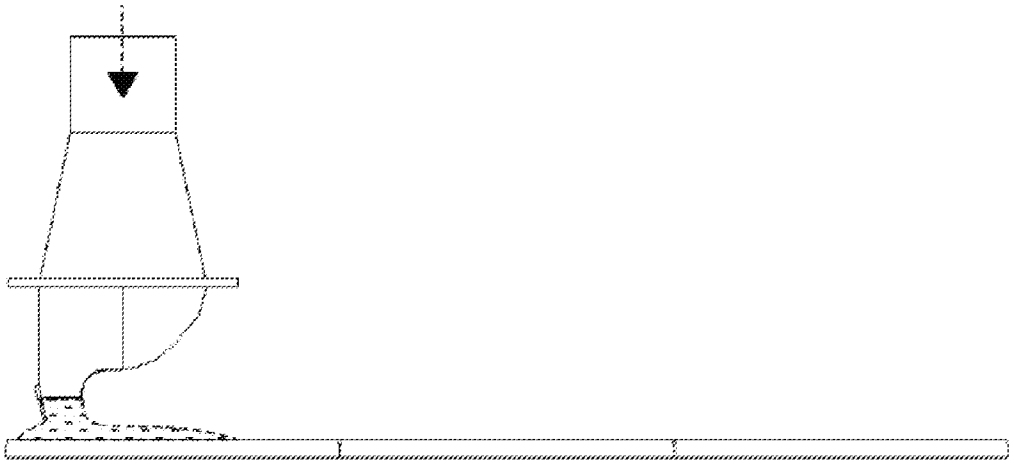
FIGS. 21A and 21B Isometric drawings in side elevation view and plan view showing an embodiment of the invention's feeder channel to a filter separator machine with vertical feeding of fluid and example of flow distribution and coverage ratio of a homogeneous fluid in a separation filter relative to the feed angle of fluid. The arrow indicates exemplary the main direction.
Figure 21B:
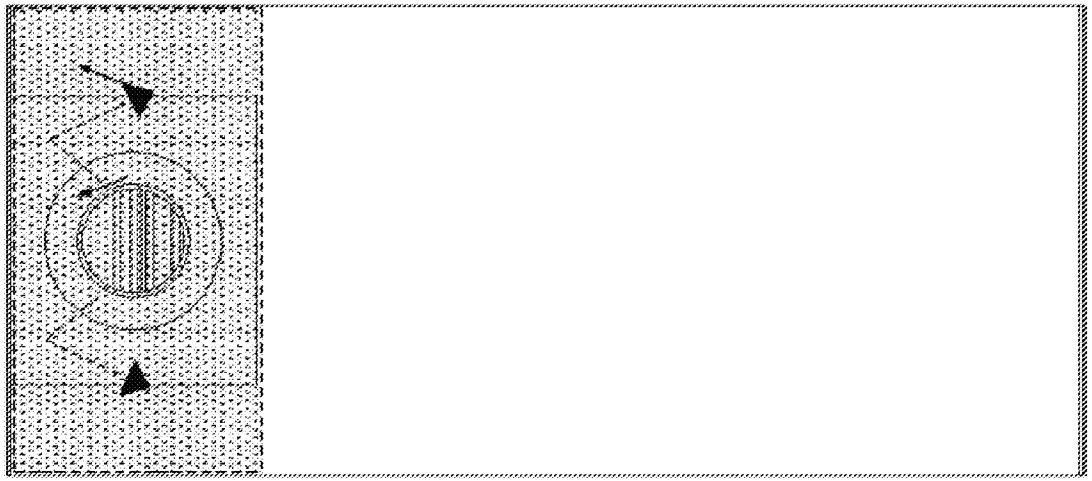
Figure 22A:
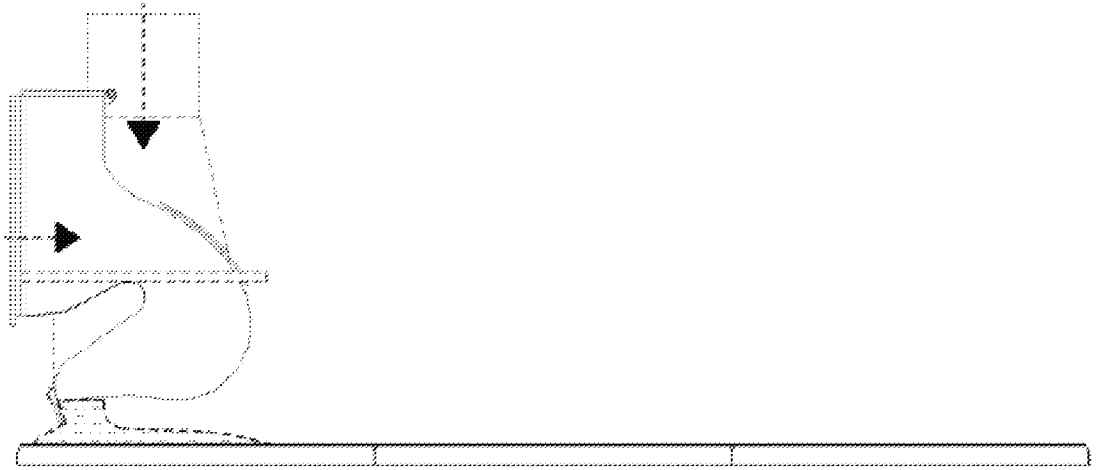
FIGS. 22A and 22B: Isometric drawing in side elevation view and plan view showing an embodiment of the invention's feeder channel to a filter separator machine provided with horizontal and vertical feeding of fluid and an example of flow distribution and coverage ratio of a homogeneous fluid on a separation filter relative to the feed angle of the fluid. The arrow indicates exemplary a main direction and distribution of the same on a separation filter.
Figure 22B:
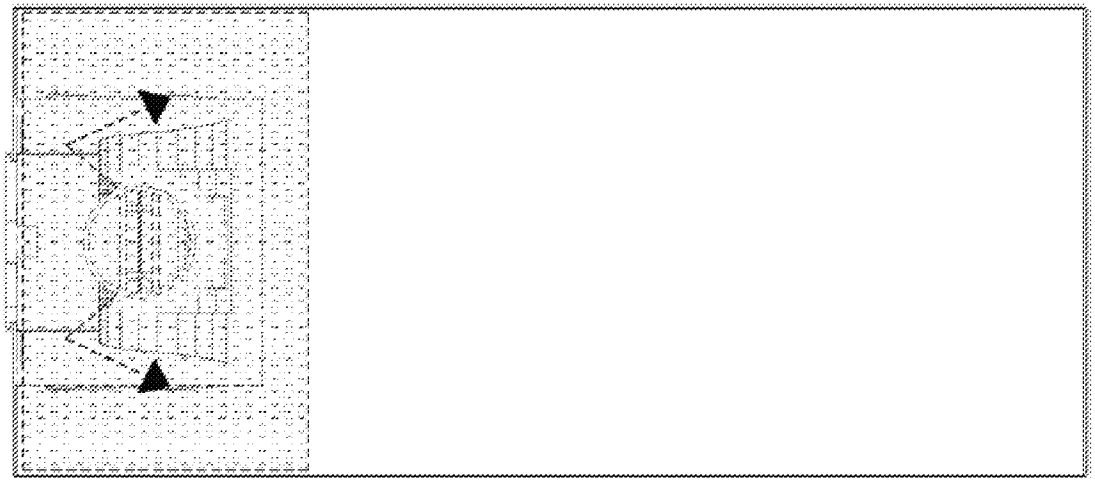
Figure 23:
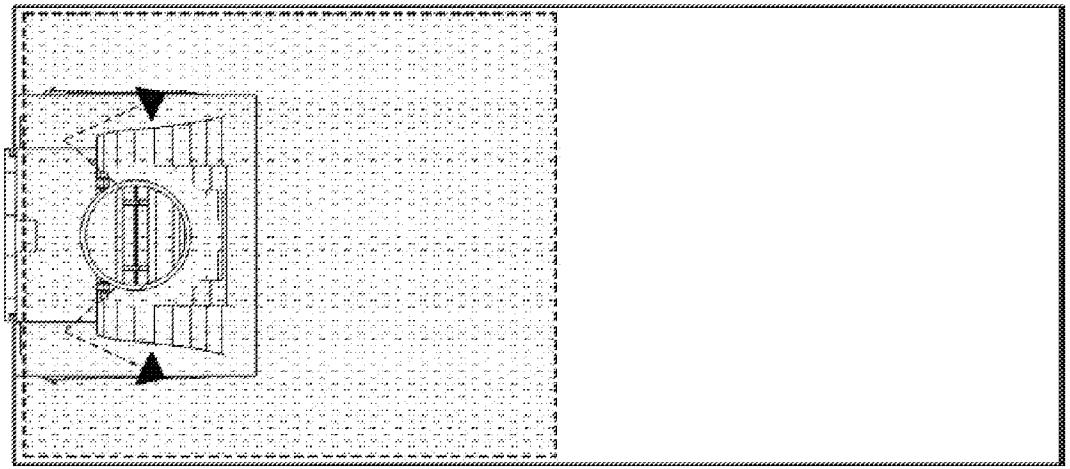
FIG. 23: Isometric plan drawing showing an embodiment of the invention's feeder channel to a filter separator machine with horizontal and vertical feeding of fluid and an example of flow distribution and coverage ratio for a homogeneous fluid in a separation filter relative to the feed angle of the fluid and increased fluid flow.
Figure 24:
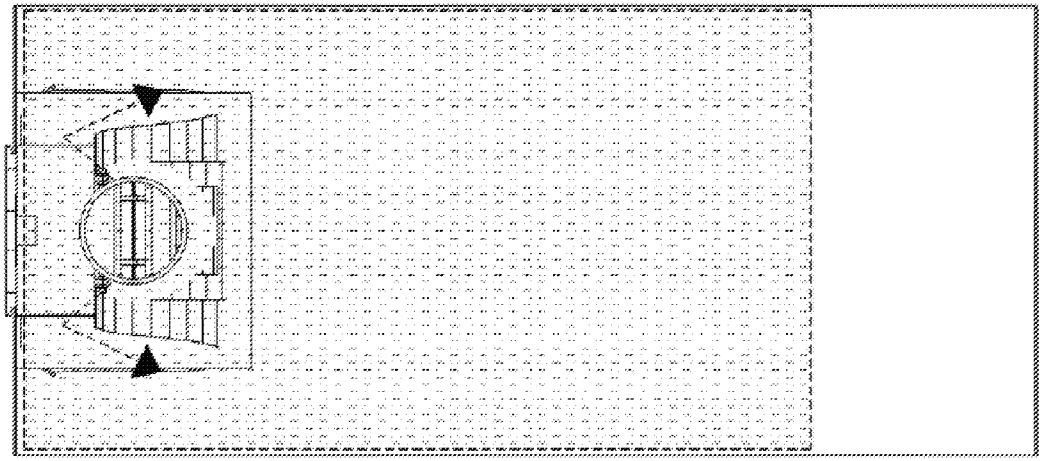
Figure 25:
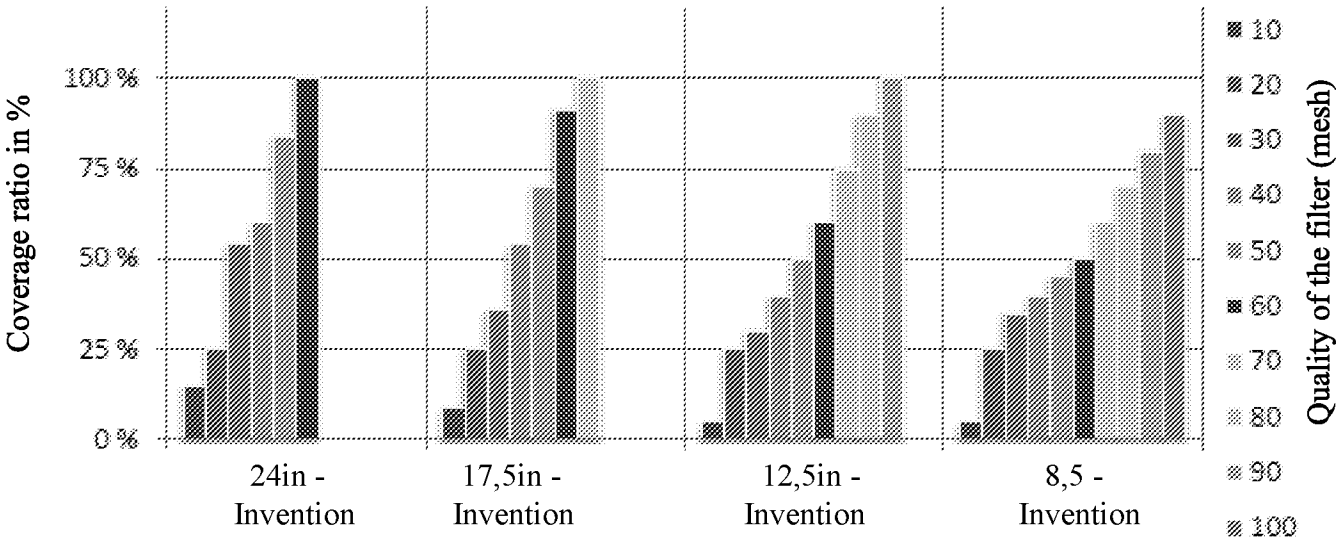
Figure 26A:
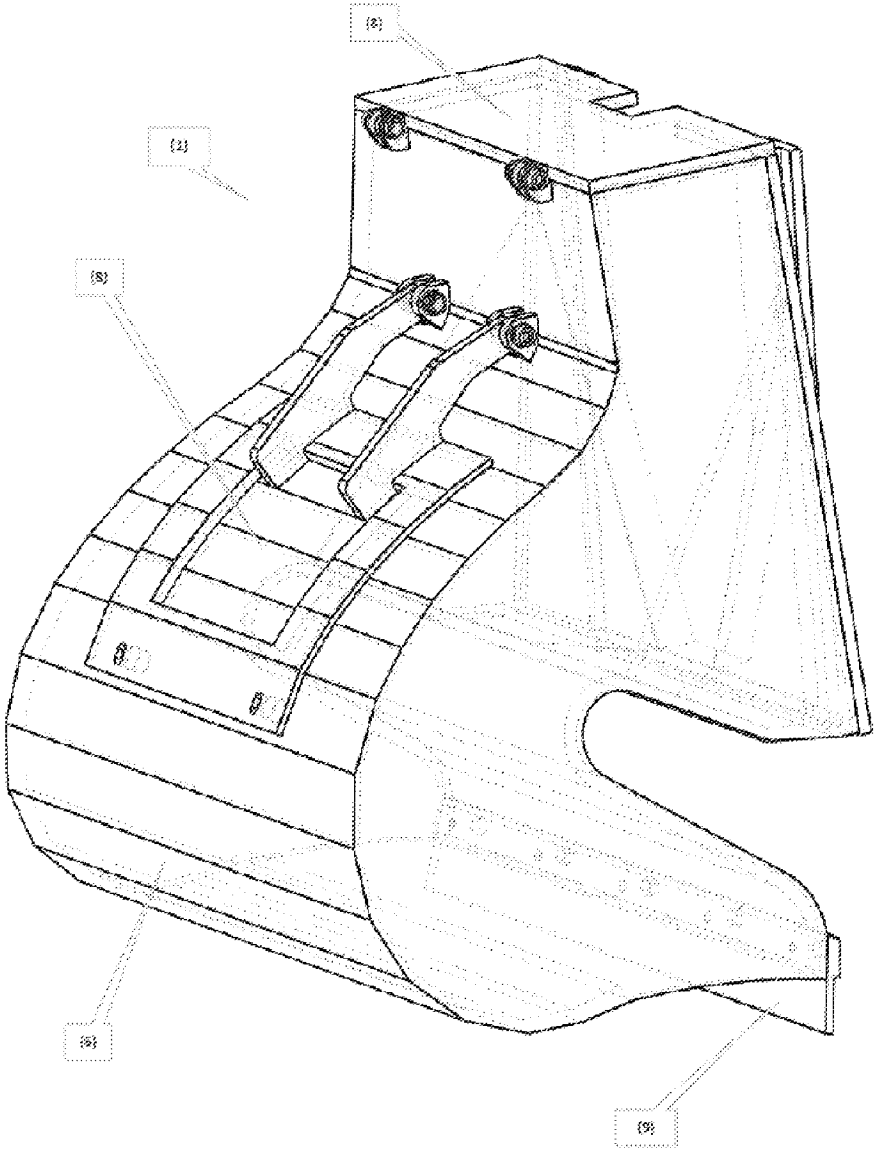
Figure 26B:
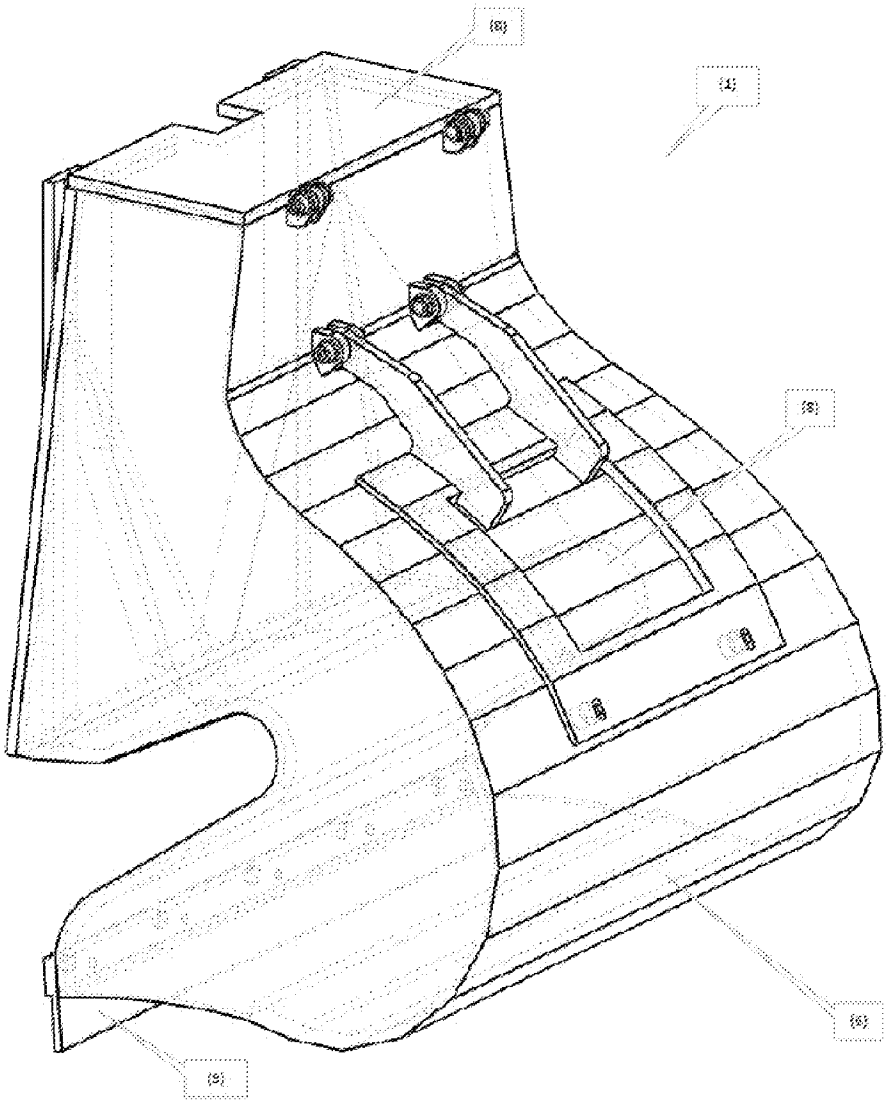
Figure 26C:
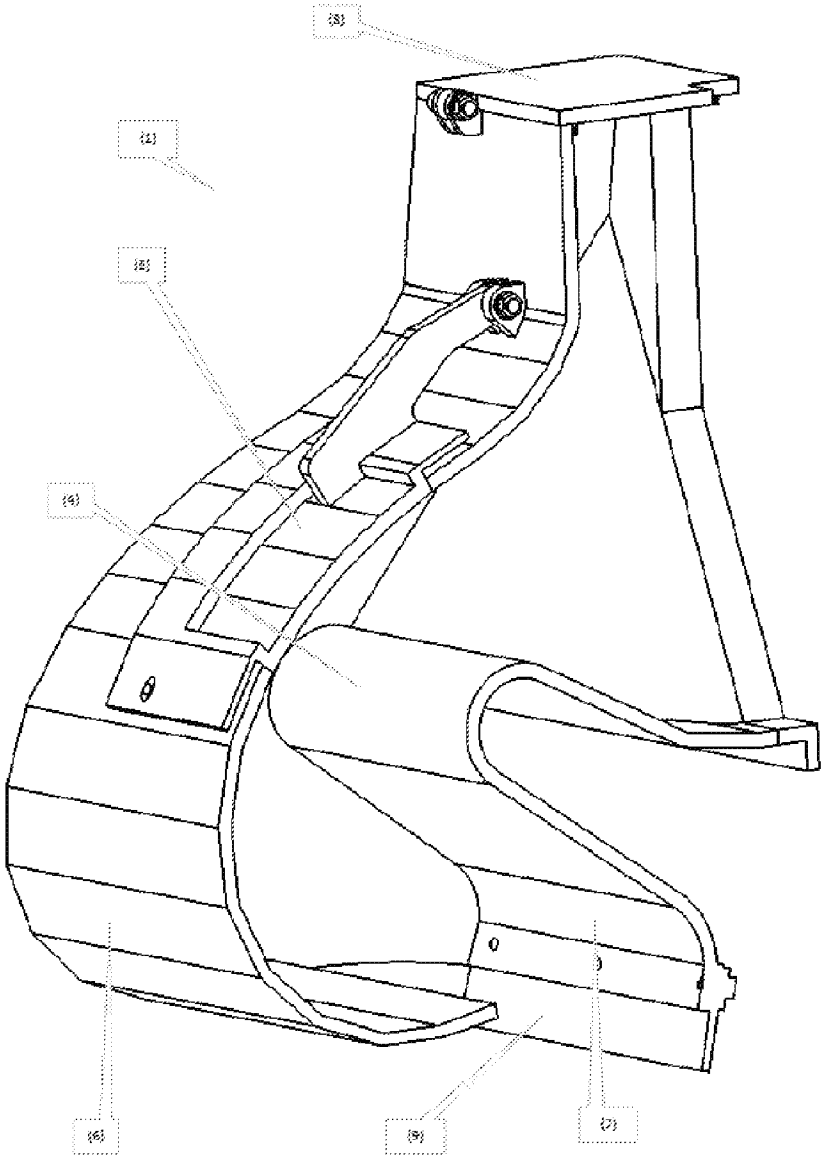
Figure 26D:
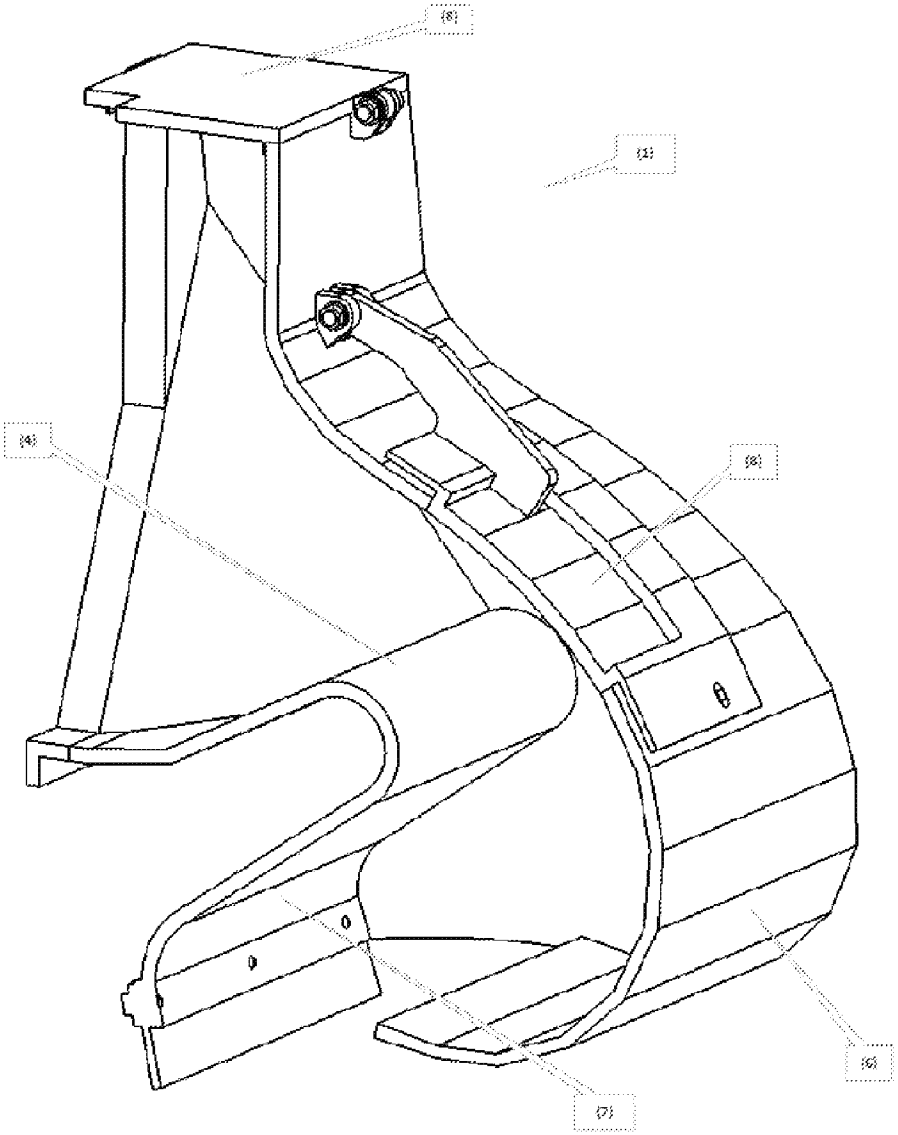
Figure 27A:
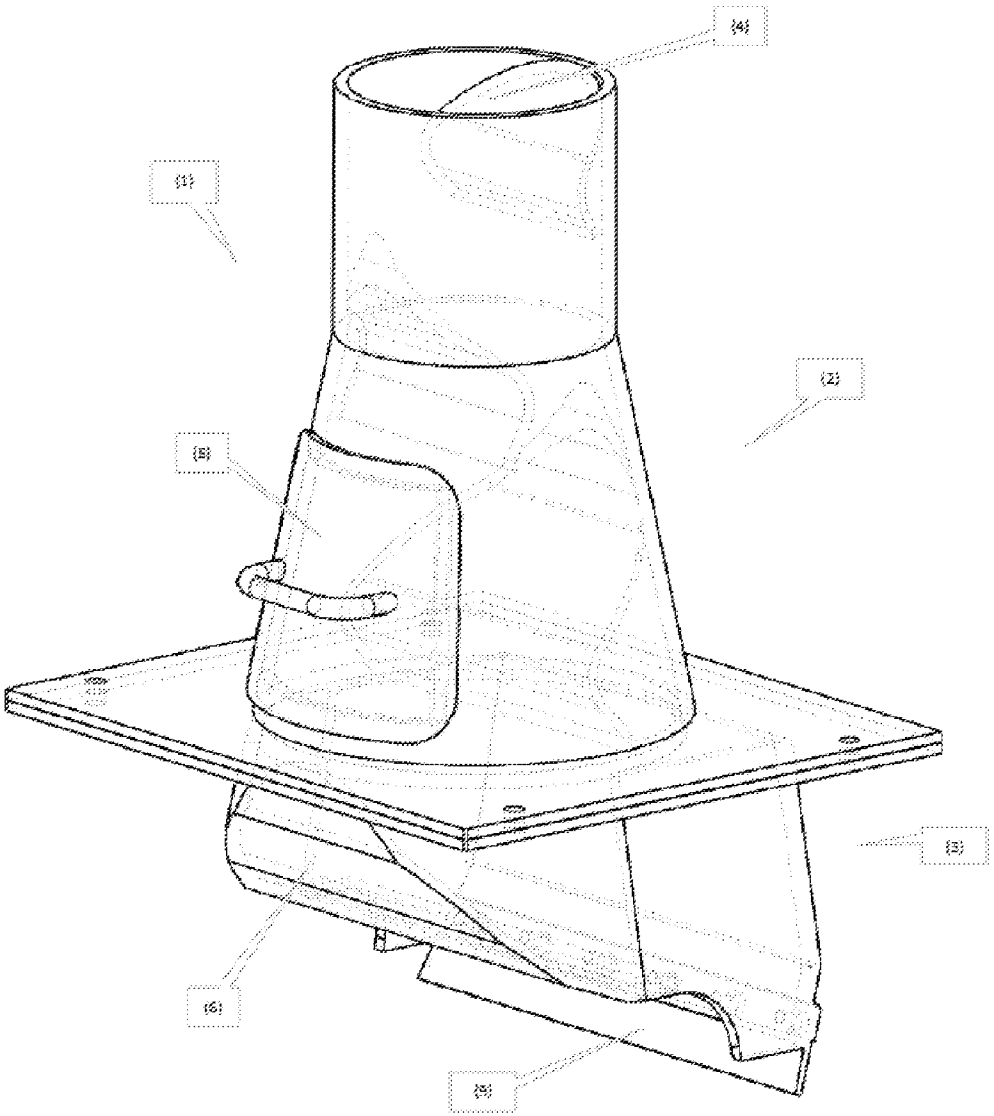
Figure 27B:
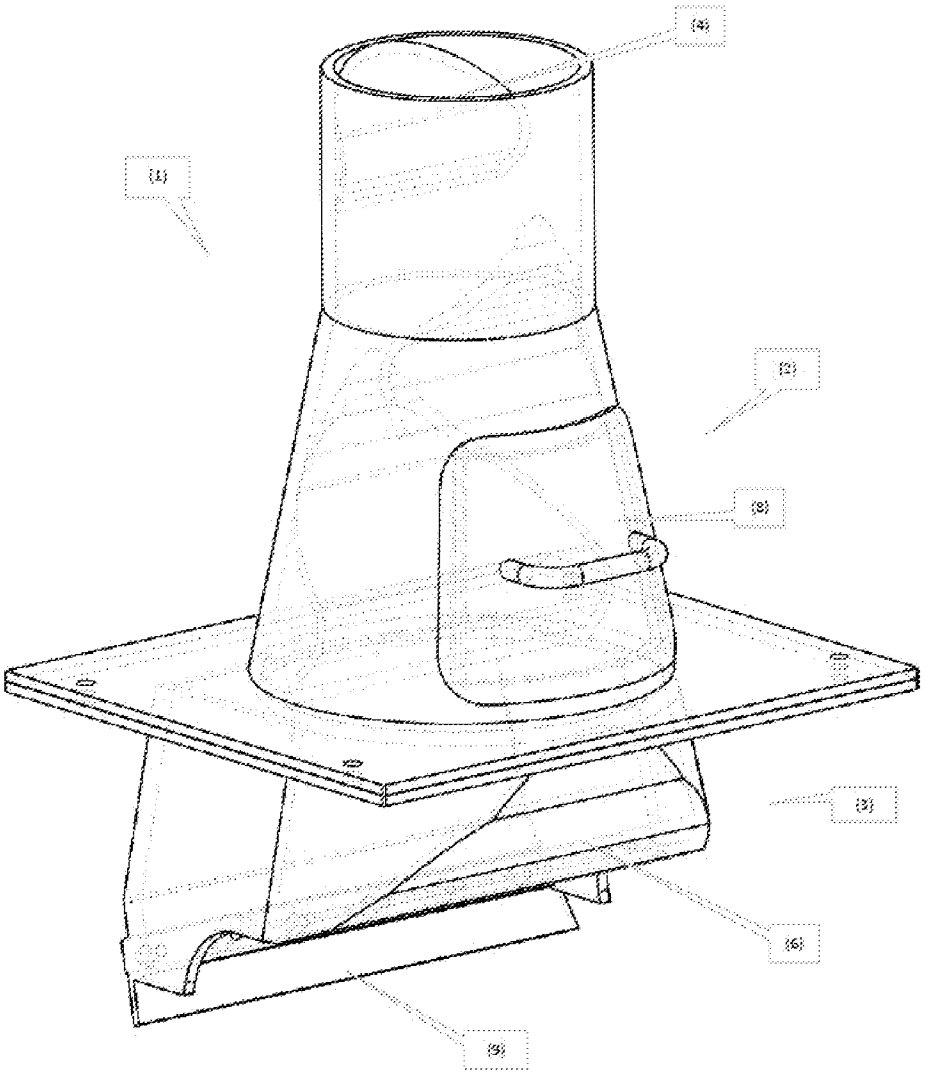
Figure 27C:
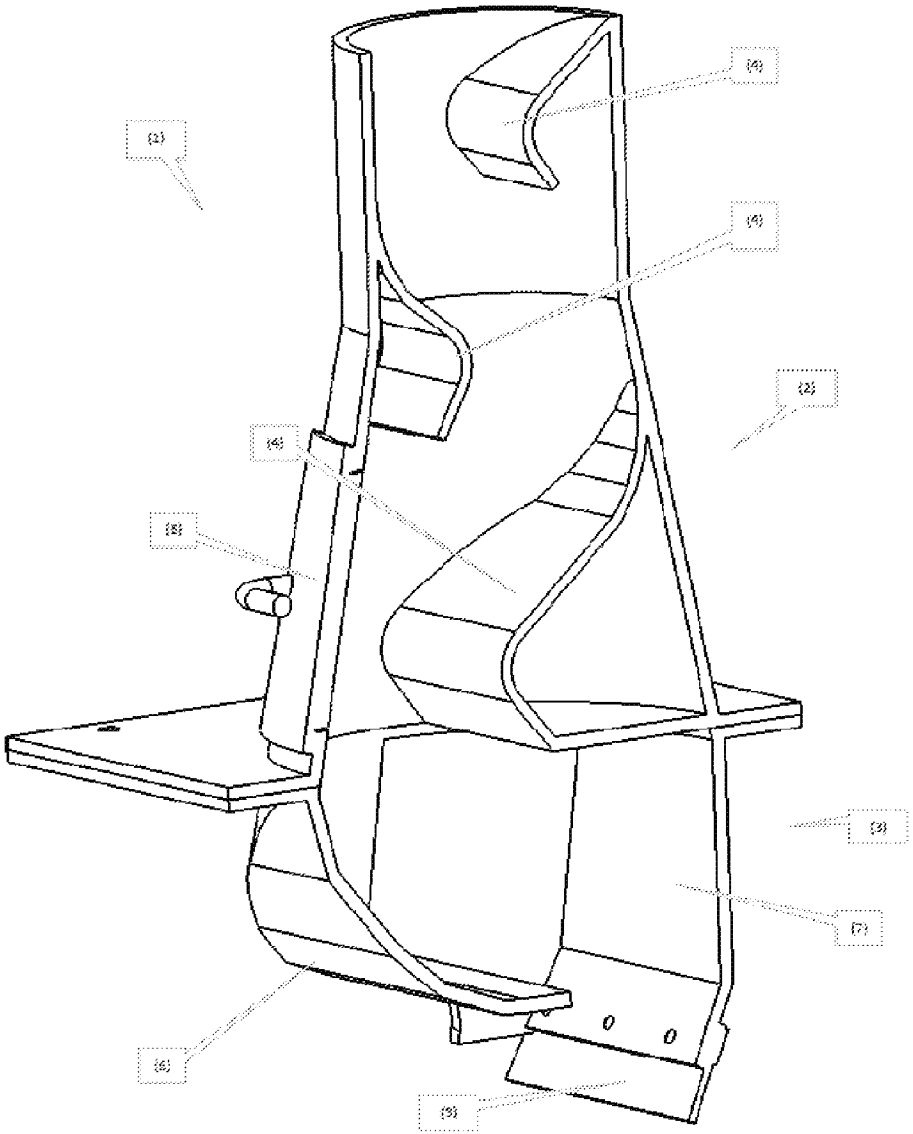
Figure 27D:
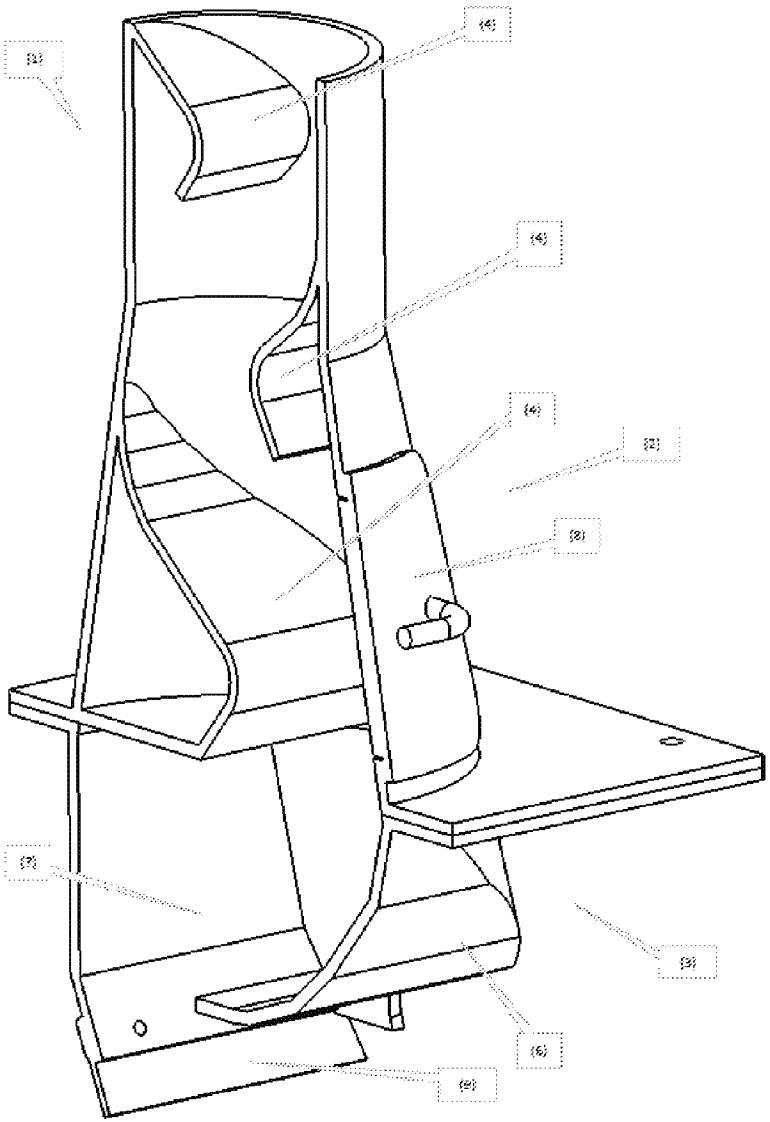
Figure 28A:
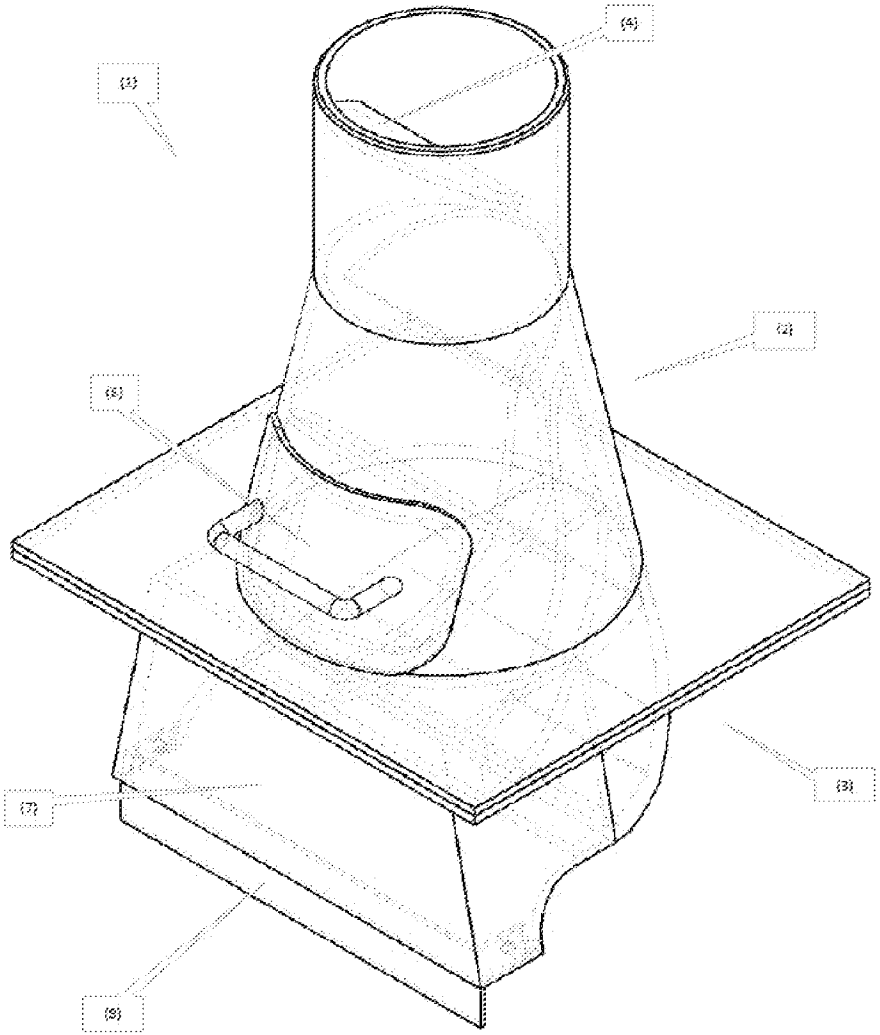
Figure 28B:
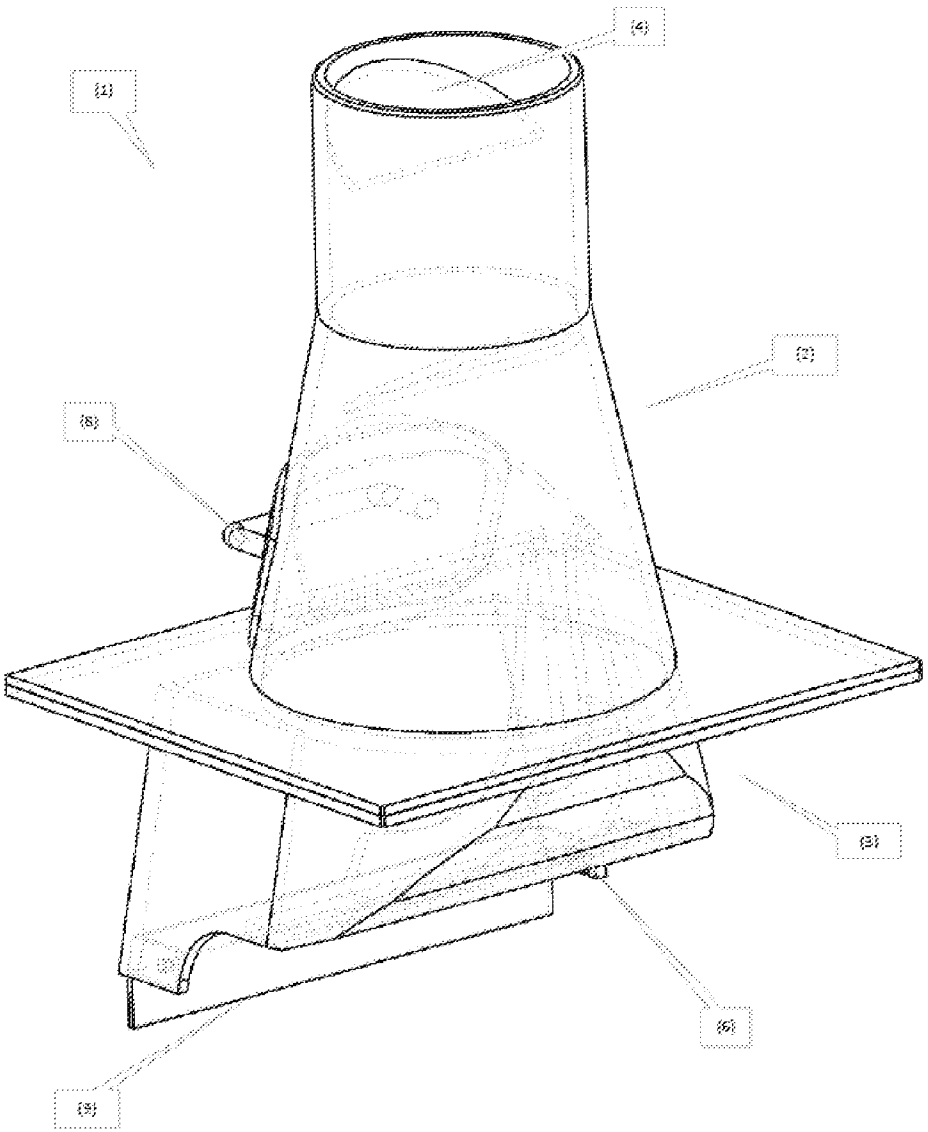
Figure 28C:
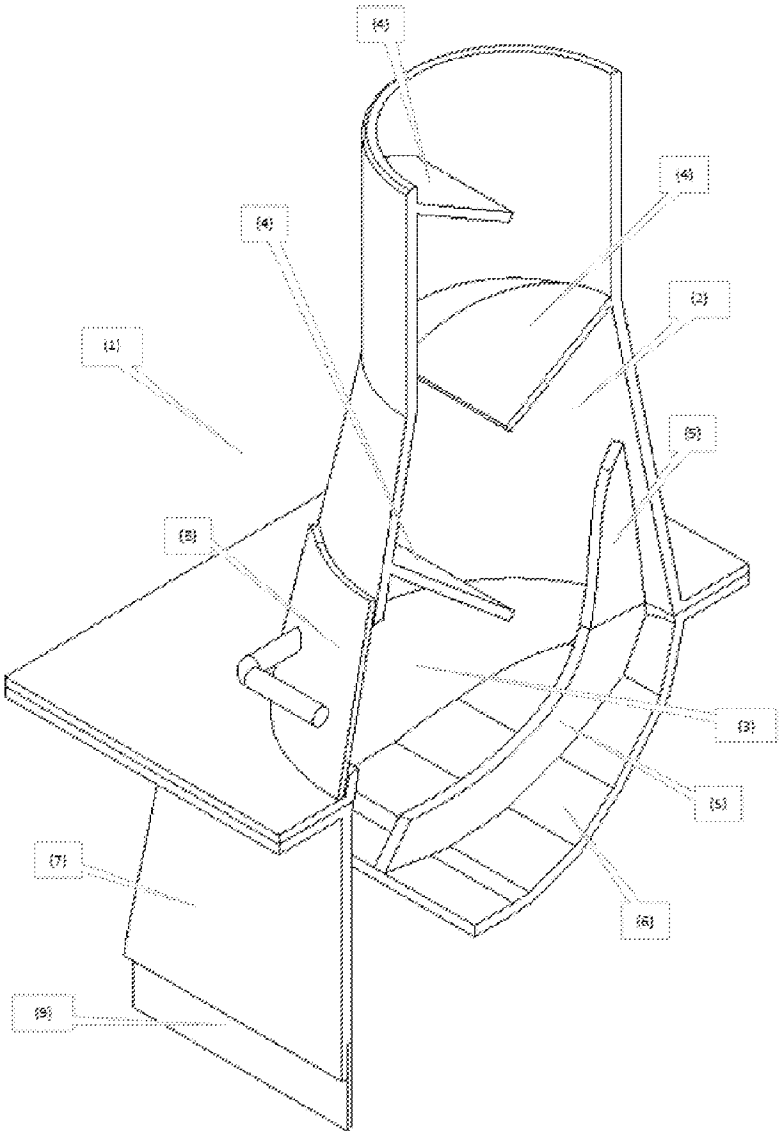
Figure 28D:
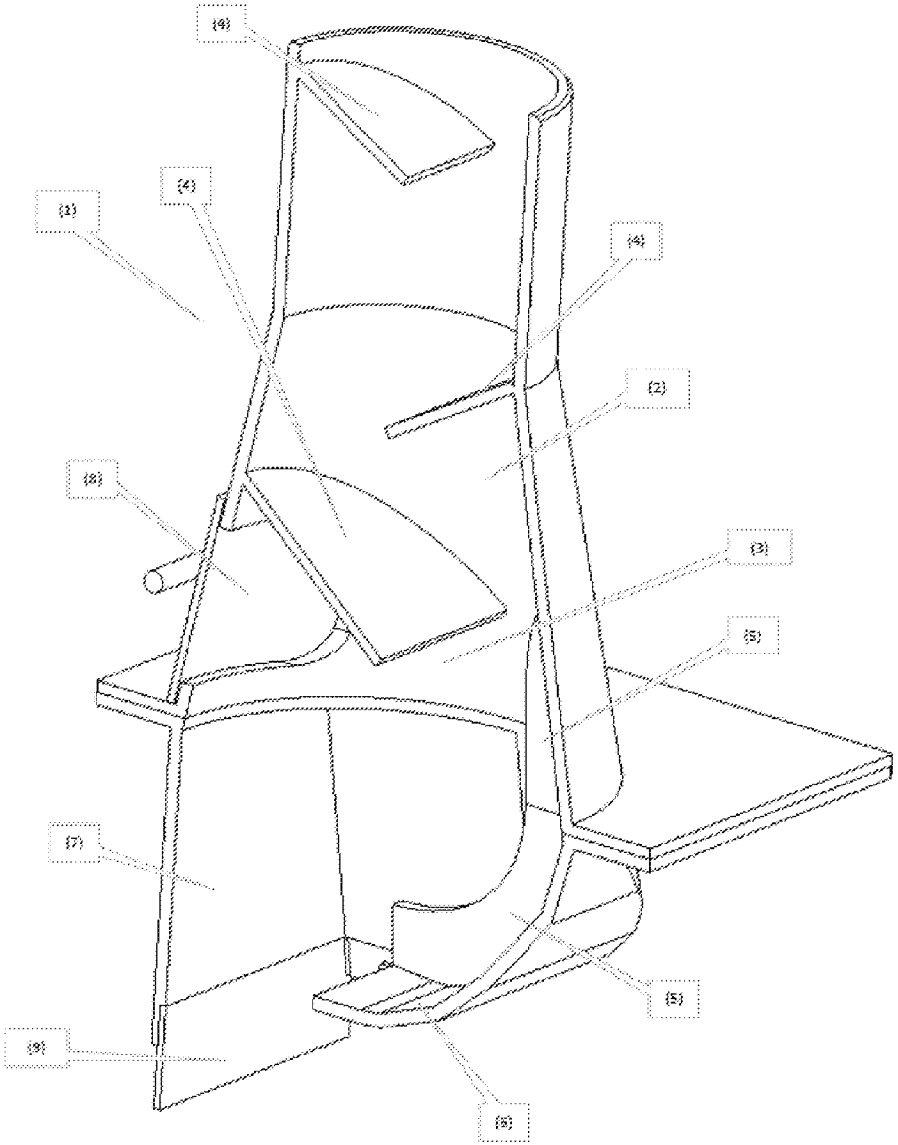

The latter has little effect on the flow distribution on the rear portion of the filter because the fluid is formed into a homogeneous flow pattern in the lower portion of the [apparatus according to the] invention. This embodiment may thus be designed as a "header box" or a "feeder box" respectively with horizontal or vertical feeding of fluid to be guided to the vibrator filter machine;

FIG. 24: Isometric drawing showing the same as FIG. 23, but through the use of finer filters which allow the liquid to spread further from the feed portion on the separation filter towards its end portion;

FIG. 25, Table 1 Shows examples of coverage ratio for fluid and particles on filter relative to filter quality (mesh) and shown for sections 24", 17.5", 12.25", and 8.5" (drilling of the well);

FIG. 26A: Isometric drawing showing an embodiment of the invention's feeder channel to the filter separator machine with horizontal feed of fluid;

FIG. 26B: Isometric drawing showing an embodiment of the invention's feeder channel to a filter separator machine with horizontal feed of fluid;

FIG. 26C: Isometric drawing showing an embodiment of the invention's feeder channel to a filter separator machine with horizontal feed of fluid;

FIG. 26D: Isometric drawing showing an embodiment of the invention's feeder channel to a filter separator machine with horizontal feed of fluid;

FIG. 27A: Isometric drawing showing an embodiment of the invention's feeder channel to a filter separator machine with vertical feed of fluid;

FIG. 27B: Isometric drawings showing an embodiment of inventions feeder channel to a filter separator machine with vertical feed of fluid;

FIG. 27C: Isometric sectional drawing showing an embodiment of the inventions feeder channel to a filter separator machine with vertical feed of fluid;

FIG. 27D: Isometric drawing showing an embodiment of the inventions feeder channel to a filter separator machine with vertical feed of fluid;

FIG. 28A: Isometric drawings showing an embodiment of the invention's feeder channel to a filter separator machine with vertical feed of fluid. This has an internal guide fin (5), which the one mentioned above does not have;

FIG. 28B: Isometric drawing showing an embodiment of the invention with internal guide fin (5), which the one mentioned above does not have;

FIG. 28C: Isometric drawing showing an embodiment of the invention with one of preferably two internal guide fins (5);

FIG. 28D: Isometric drawing showing an embodiment of the invention with one of preferably two internal guide fins (5).

100% coverage ratio (DG) incurs continuous loss of fluid on the top filter.

90% DG provides a risk of intermittent loss.

75% of DG by even front distribution does not incur any loss.

DETAILED DESCRIPTION OF THE INVENTION

The invention relates to a feeder channel (1) which has a purpose of guiding fluid and particle flow to the area of the filter that provides the best utilization of available filtration area. The feeder channel (1) is illustrated in FIGS. 14A-14E and FIG. 28D, and comprises the following features: A feeder channel (1) comprising an upper feeder channel portion (2) and a lower feeder channel portion (3) wherein the inside of the upper channel portion (2) is arranged with a guiding- and turning plate (4), which are inclined towards each other relative to the vertical line so that independent of the orientation of the liquid supply direction and angle, the liquid and the particles will have a more homogeneous flow when being guided, preferably, but not necessarily, via an inwardly guide fin (5), to a mouth guide plate (6) which turns the liquid to an opposite direction of the main transport direction of the filter, towards the landing point of the same [liquid] against a distributor plate (7). From that place the liquid is guided out and down to the beginning of the filter via the lower portion of the of the feeder channel (1)—the distributor skirt (9).

In order to allow entry for carrying out inspection, the feeder channel (1) may have an inspection hatch (8) as illustrated. In the embodiment shown in FIG. 26D the fluid flow will arrive from the shaker box arranged at the rear side, which distributes fluid to the various feeder channels, e.g. in a number of five.

A feeder channel as shown in this figure may have a maximum capacity of about 1750 liters per minute. The liquid will then run through the gate or valve shown in the left part of the drawing, and be guided upwards along the guide and turn plate (4) and simultaneously outwards to both sides along the inclined surfaces to the sides of the inlet gate. If the fluid flow is relatively low the fluid will be able to adhere over the knee at the tip of the guide and turn plate (4) and follow along down the distributor plate (7) and flow down on the distributor skirt (9) and spread out and flow down onto the separation filter right up at its beginning so that the entire transport path [is at] the separation filter, which occurs towards the right side in this drawing.

In the same embodiment of the invention, if the fluid flow is large, the liquid will flow more vigorously over the guide and—turn plate (4) and release it at the knee and no longer necessarily follow along the distributor plate (7), but end up over at the side of the mouth guide plate (6) and thereby guided back towards the distributor plate (7), down along the distributor skirt (9) and out onto the separation filter on the same desired portion completely in its beginning relative to the transport path.

If we look at FIG. 27C, the same conditions are valid:

At low liquid flow, the liquid may pass relatively unimpeded down towards the lower guide and turn plate (4), which here is inclined downwards from its upstream side, and the fluid may follow along around the knee on the guide and turn plate (4), and ends up near or along the distributor plate (7) and run down on the distributor skirt (9) near the beginning of the separation filter, of which the main transport direction in this perspective is towards the left from the distributor skirt (9).

In this embodiment the guide and turn plate (4), in the case where the fluid flow becomes larger, guides the fluid flow over to the side of the opposite below [itself] which is the mouth guide plate (6), which will turn the flow opposite relative to main transport direction of the separation filter and lead the fluid flow towards the distributor plate (7) which in turn releases the fluid down along distributor skirt (9) and one achieves the same result: the fluid utilizes the entire beginning of the separation filter.

A distributor skirt (9) prevents splash and dash of fluid back towards the end wall on the shale shaker. The feeder channel (1) according to the invention leads to an increase in capacity for each shale shaker at the same operating conditions which includes screen-cloth configuration, or enables the use of finer filters for the same operating conditions. The latter mentioned above leads in turn to a reduced consumption of main screen cloth and hence improved filtering.

The invention claimed is:

1. A feeder channel of a mud shaker for supplying a particle-containing drilling mud fluid flow to an inlet portion at a first end of a vibrating separation filter, said vibrating separation filter extending in a main transport direction towards an cnda second end portion of said vibrating separation filter, wherein a plane parallel with the main transport direction of the vibrating separation filter is defined as a horizontal plane, and a plane vertical to the main transport direction is defined as a vertical plane, the feeder channel comprising:

an upper feeder channel portion for feeding in said fluid flow;

at least one lower guide- and turn plate arranged to deflect said fluid flow in a direction of said main transport direction of said vibrating separation filter;

a lower feeder channel portion comprising a mouth guide plate connected thereto and arranged to turn said fluid flow mainly in an opposite direction of said main transport direction of said vibrating separation filter;

a distributor plate connected to the lower feeder channel portion and provided with a lower distributor skirt extending transversely at a feeding in portion near said first end of said vibrating separation filter, wherein the mouth guide plate is configured to direct said fluid flow toward the distributor plate.

2. The feeder channel according to claim 1, wherein said upper inflow channel portion and said lower channel inflow portion form a mainly arched profile in the vertical plane.

3. The feeder channel according to claim 2, wherein said upper inflow channel portion and said lower inflow channel portion each have a frusto-conical shape.

4. The feeder channel according to claim 1, wherein said guide- and turn plate is angled and configured to direct the fluid flow toward a direction between the horizontal plane and the vertical plane.

5. The feeder channel according to claim 4, wherein said guide- and turn plate has a plane profile.

6. The feeder channel according to claim 1, wherein said upper inflow channel portion and said lower inflow channel portion each comprise an inwardly protruding guide fin.

7. The feeder channel according to claim 1, wherein said mouth guide plate includes a portion with an arched profile.

8. The feeder channel according to claim 1, wherein said distributor plate includes a portion with an arched profile.

9. The feeder channel according to claim 8, wherein said distributor plate is made out of a material of steel, carbide, ceramic, or a composite of steel, carbide and ceramic.

10. The feeder channel according to claim 1, wherein said distributor skirt is arranged for preventing splashing against a rear portion of said vibrating separator filter in said mud shaker.

11. The feeder channel according to claim 4, wherein said guide- and turn plate has an arched concave profile.

12. The feeder channel according to claim 4, wherein said guide- and turn plate has an arched convex profile.

13. The feeder channel according to claim 2, wherein said upper inflow channel portion and said lower inflow channel portion each have a straight shape.

14. The feeder channel according to claim 1, wherein the mouth guide plate includes an end portion parallel with the horizontal plane, said end portion being configured to direct said fluid flow toward the opposite direction of said main transport direction of said vibrating separation filter.

* * * * *